US007110703B2

(12) United States Patent
Uratani et al.

(10) Patent No.: US 7,110,703 B2
(45) Date of Patent: Sep. 19, 2006

(54) DEVELOPING DEVICE, PROCESS CARTRIDGE AND IMAGE FORMING APPARATUS

(75) Inventors: Shunsuke Uratani, Susono (JP); Noriyuki Komatsu, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 86 days.

(21) Appl. No.: 10/927,109

(22) Filed: Aug. 27, 2004

(65) Prior Publication Data

US 2005/0100367 A1 May 12, 2005

(30) Foreign Application Priority Data

Aug. 29, 2003 (JP) ..... 2003-308151

(51) Int. Cl.
*G03G 15/08* (2006.01)

(52) U.S. Cl. ..... 399/254; 399/111; 399/119; 399/262

(58) Field of Classification Search ..... 399/107, 399/111, 119, 252, 254, 255, 262
See application file for complete search history.

(56) References Cited

U.S. PATENT DOCUMENTS 6,081,684 A * 6/2000 Naganuma et al. ..... 399/275
6,275,674 B1 * 8/2001 Sugimoto ..... 399/254
6,360,066 B1 * 3/2002 Kawahito et al. ..... 399/254
6,519,434 B1 * 2/2003 Izumi et al. ..... 399/223
6,671,477 B1 12/2003 Komatsu et al. ..... 399/113
2004/0134070 A1 7/2004 Komatsu et al. ..... 29/895.2

FOREIGN PATENT DOCUMENTS

JP 6-348126 12/1994
JP 2000-35710 2/2000
JP 2000-181207 6/2000
JP 2001-75343 3/2001

* cited by examiner

*Primary Examiner*—Hoan Tran
(74) *Attorney, Agent, or Firm*—Fitzpatrick, Cella, Harper & Scinto

(57) ABSTRACT

A developing apparatus for an electrophotographic image forming apparatus, the developing apparatus includes a developing means for developing an electrostatic latent image formed on an electrophotographic photosensitive member; a developer accommodating container for accommodating a developer to be used by the developing member; a first stirring member for receiving a driving force from a main assembly of the electrophotographic image forming apparatus to star the developer accommodated in the developer accommodating container; and a second stirring member for stirring the developer accommodated in the developer accommodating container. The second stirring member is rotatable by being contacted by the first stirring member rotated through a predetermined angle when the first stirring member receives the driving force from the main assembly of the apparatus. The first stirring member stirs at least a part of a region of the developer which is stirred by the second stirring member.

14 Claims, 19 Drawing Sheets

DEVELOPING DEVICE, PROCESS CARTRIDGE AND IMAGE FORMING APPARATUS

FIELD OF THE INVENTION AND RELATED ART

The present invention relates to a developing apparatus, a process cartridge, and an electrophotographic image forming apparatus.

In the field of an electrophotographic image forming apparatus employing an electrophotographic image formation process, it has been a common practice to employ a process cartridge system, in which an electrophotographic photosensitive member, and a single or plurality of processing means which act on the electrophotographic photosensitive member, are integrally placed in a cartridge removably mountable in the main assembly of an image forming apparatus. According to this process cartridge system, apparatus maintenance can be carried out by a user by himself, without the need for relying on service personnel, drastically improving an image forming apparatus in operational efficiency. Thus, a process cartridge system has been widely used in the field of an image forming apparatus.

Developer is conveyed by a stirring means from a developer container to a developing means while being stirred by the stirring means.

In some cases, a developing apparatus comprising a developer container is placed in a cartridge, creating a development cartridge individually and removably mountable in the main assembly of an electrophotographic image forming apparatus. Also in the case of these development cartridges, developer is conveyed by a stirring member from the developer container to developing means while being stirred by the stirring member.

As a stirring means, in accordance with the prior art, for stirring the developer in a developer container, there is a means which employs a stirring rod rotatable about a shaft (Japanese Laid-open Patent Application 2000-035710).

There is also a stirring means, in accordance with the prior art, for stirring the developer in a developer container, which employs an elastic sheet rotatable about a shaft (Japanese Laid-open Patent Application 2001-075343).

However, the above mentioned stirring means are problematic for the following reason. That is, the developer in a cartridge (process cartridge, development cartridge. etc.) removably mountable in an electrophotographic image forming apparatus sometimes becomes agglomerated due to the vibrations or the like which occur during shipment. Thus, an electrophotographic image forming apparatus had to be enabled to output a substantially larger amount of driving force during its startup period than the rest of the time, in order to deal with the agglomerated developer. Therefore, the motor for the apparatus had to be increased in power, which in turn increased the motor cost and/or size. Further, a stirring member had to be increased in strength, sometimes requiring the stirring member to be increased in size, which in turn required the apparatus to be increased in size. These problems become exacerbated as a developer container is increased in size to increase the service life of a cartridge.

Thus, such a design has been proposed that loosens the developer in the developer container by oscillating a stirring member comprising stirring wings in the direction parallel to the axial direction of the stirring member, when the mechanical resistance against the stirring member is substantial (Japanese Laid-open Patent Application 2000-181207).

Also, for the purpose of reducing the amount of the torque necessary to rotate the developer stirring-conveying means in a developing apparatus for the very first time, such a developing apparatus has been designed that is provided with a developer stirring-conveying member comprising a plurality of developer stirring wings which are aligned in parallel in the lengthwise direction of the developer stirring-conveying member, are different in the range across which they stir the developer, and are linked together with screws, so that as the developer stirring-conveying means is rotated, the bodies of toner in the different areas of the sweeping range of the developer stirring-conveying member are consecutively loosened (Japanese Laid-open Patent Application 6-348126).

SUMMARY OF THE INVENTION

Thus, the primary object of the present invention is to provide a developing apparatus substantially smaller in the amount of the torque necessary to stir the developer therein during a startup period than a developing apparatus in accordance with the prior art, a process cartridge compatible with such a developing apparatus, and an electrophotographic image forming apparatus compatible with such a developing apparatus and a cartridge.

Another object of the present invention is to provide a developing apparatus which makes it possible to substantially reduce an electrophotographic image forming apparatus in size, a cartridge compatible with such a developing apparatus, and an electrophotographic image forming apparatus compatible with such a developing apparatus and a cartridge.

Another object of the present invention is to provide a developing apparatus substantially smaller in the amount of the force necessary to stir the developer therein even after the developer therein agglomerates while the electrophotographic image forming apparatus is not used, than a developing apparatus in accordance with the prior art, a process cartridge compatible with such a developing apparatus, and an electrophotographic image forming apparatus compatible with such a developing apparatus and a process cartridge.

According to an aspect of the present inventions there is provided a developing apparatus for an electrophotographic image forming apparatus, the developing apparatus comprising developing means for developing an electrostatic latent image formed on an electrophotographic photosensitive member; a developer accommodating container for accommodating a developer to be used by the developing means; a first stirring member for receiving a driving force from a main assembly of the electrophotographic image forming apparatus to stir the developer accommodated in the developer accommodating container; and a second stirring member for stirring the developer accommodated in the developer accommodating container, the second stirring member being rotatable by being contacted by the first stirring member rotated through a predetermined angle when the first stirring member receives the driving force from the main assembly of the apparatus, wherein the first stirring member stirs at least a part of a region of the developer which is stirred by the second stirring member.

According to another aspect of the present invention, there is provided a process cartridge detachably mountable to a main assembly of an electrophotographic image forming apparatus, the process cartridge comprising an electrophotographic photosensitive member; developing means for developing an electrostatic latent image formed on the electrophotographic photosensitive member; a developer accommodating container for accommodating a developer to be used by the developing means; a first stirring member for receiving a driving force from a main assembly of the electrophotographic image forming apparatus to stir the developer accommodated in the developer accommodating container; and a second stirring member for stirring the developer accommodated in the developer accommodating container, the second stirring member being rotatable by being contracted by the first stirring member rotated through a predetermined angle when the first stirring member receives the driving force from the main assembly of the apparatus, wherein the first stirring member stirs at least a part of a region of the developer which is stirred by the second stirring member.

According to a further aspect of the present invention, there is provided an electrophotographic image forming apparatus for forming an image on a recording material, said apparatus comprising (i) a driving motor: (ii) an electrophotographic photosensitive member; (iii) a developing apparatus including: developing means for developing an electrostatic latent image formed on the electrophotographic photosensitive member; a developer accommodating container for accommodating a developer to be used by the developing means; a first stirring member for receiving a driving force from a main assembly of the electrophotographic image forming apparatus to stir the developer accommodated in the developer accommodating container; and a second stirring member for stirring the developer accommodated in the developer accommodating container, the second stirring member being rotatable by being contacted by the first stirring member rotated through a predetermined angle when said first stirring member receives the driving force from the main assembly of the apparatus, wherein the first stirring member stirs at least a part of a region of the developer which is stirred by the second stirring member; and (iv) feeding means for feeding the recording material.

According to a further aspect of the present invention, there is provided an electrophotographic image forming apparatus for forming an image on a recording material, the apparatus comprising (i) a driving motor; (ii) mounting means for mounting a process cartridge, the process cartridge including: an electrophotographic photosensitive member; developing means for developing an electrostatic latent image formed on the electrophotographic photosensitive member: a developer accommodating container for accommodating a developer to be used by the developing means; a first stirring member for receiving a driving force from a main assembly of the electrophotographic image forming apparatus to stir the developer accommodated in the developer accommodating container; and a second stirring member for stirring the developer accommodated in the developer accommodating container, the second stirring member being rotatable by being contacted by the first stirring member rotated through a predetermined angle when the first stirring member receives the driving force from the main assembly of the apparatus, wherein the first stirring member stirs at least a part of a region of the developer which is stirred by the second stirring member; and (iii) feeding means for feeding the recording material.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Figure 1:
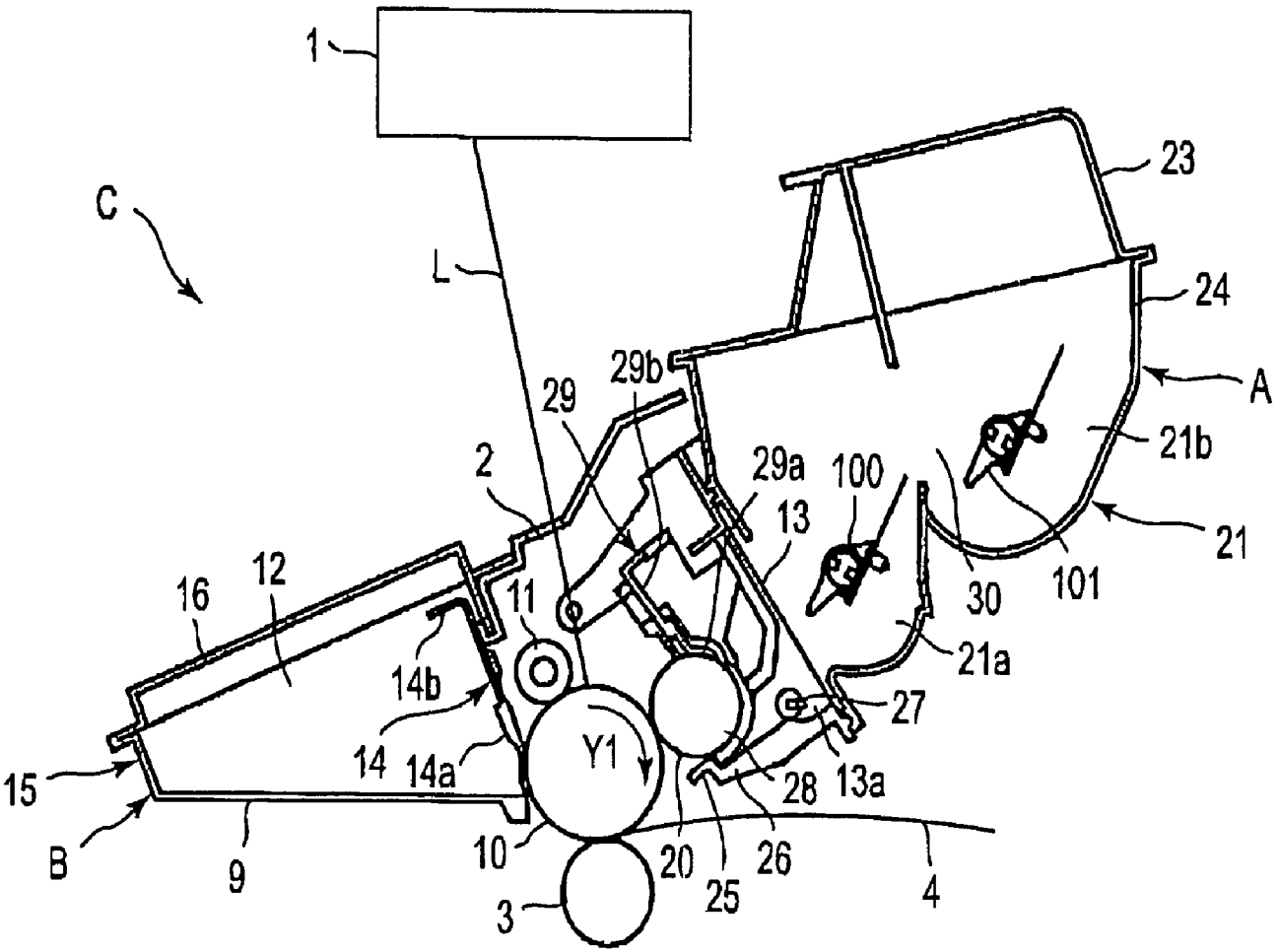
FIG. 1 is a sectional view of the process cartridge in the first embodiment of the present invention, showing the general structure thereof.

Hereinafter, the developing apparatus, cartridge, and an electrophotographic image forming apparatus in accordance with the present invention will be described in more detail with reference to the appended drawings.

Embodiment 1

In the following description of the preferred embodiments of the present invention, the "widthwise direction" of a cartridge is the direction parallel to the direction in which the cartridge is mounted into, or removed from, the main assembly of an image forming apparatus. Its the same as the direction in which recording medium is conveyed. The "lengthwise direction" of a cartridge is the direction intersecting (virtually perpendicular) the direction in which the cartridge is mounted into, or removed from, the main assembly of an image forming apparatus. It is virtually parallel to the surface of the recording medium in the apparatus main assembly, and intersects the recording medium conveyance direction. Further, the "upward direction" of a cartridge is the upward direction of the cartridge properly positioned in the apparatus main assembly, whereas the "downward direction" of a cartridge is the downward direction of the cartridge properly positioned in the apparatus main assembly.

[General Structure of Electrophotographic Image Forming Apparatus]

First, referring to FIG. 19, the general structure of the electrophotographic image forming apparatus in this embodiment will be described. The laser beam printer in FIG. 19 forms an image on a recording medium 4 (for example, recording paper, OHP sheet, fabric, etc.) with the use of one of the electrophotographic image formation processes, in response to image information signals from an, external device such as a personal computer connected to the main assembly Pa of the image forming apparatus so that two-way communication is possible between the two.

The peripheral surface of the photosensitive drum 10 as an electrophotographic photosensitive member in the form of a drum is uniformly charged by the charge roller 11. The uniformly charged peripheral surface of the photosensitive drum 10 is exposed to a beam of laser light L projected from an optical means 1 (exposing means) while being modulated with image information signals. As a result, an electrostatic latent image in accordance with the image information signal is formed on the peripheral surface of the photosensitive drum 10. This latent image on the photosensitive drum 10 is developed by the combination of the developing means (which will be described later) and developer (which hereinafter may be referred to as toner). As a result, a visible image is formed of toner, on the peripheral surface of the photosensitive drum 10 (hereinafter, a visible image formed of toner will be referred to simply as a toner image).

Meanwhile, the recording media 4 having been loaded in the sheet feeder cassette 6*a* are conveyed therefrom by the pickup roller 6*b*, the conveyance guide 6*c*, and a pair of registration rollers 6*e*, in synchronism with the progression of the formation of a toner image Then, the recording medium 4 is moved through the nip formed between the photosensitive drum 10, and the transfer roller 3 to which a predetermined amount of voltage is applied, and as the recording medium 4 is moved through the nip, the toner image on the photosensitive drum 10 is transferred onto the recording medium 4. After receiving the toner image, the recording medium 4 is conveyed by the conveyance guide 6*f* to the fixing means 5 comprising a driver roller 5*c*, and a fixation roller 5*b*, which contains a heater 5*a*. The recording medium 4 and the unfixed toner image thereon are moved through the nip formed by the fixation roller 5*b* and driver roller 5*c*. While they are moved through the nip, they are subjected to heat and pressure. As a result, the unfixed toner image is fixed to the recording medium 4. Thereafter, the recording medium 4 is conveyed further and discharged into the delivery tray 7, by the pair of registration rollers 6*i*. The pickup roller 6*b*, the conveyance guide 6*c*, the pair of registration rollers 6*e*, the conveyance guide 6*f*, the pair of discharge rollers 6*i*, etc., make up the means for conveying the recording medium.

[Cartridge]

Next, referring to FIG. 1, the process cartridge (which hereinafter will be referred to as cartridge C) removably mountable in the main assembly of an electrophotographic image forming apparatus will be described.

In FIG. 1, the development unit A has a developer container 21 (which hereinafter may be referred to as a toner container) for holding magnetic single-component developer (toner) composed virtually of magnetic resin toner particles (which may contain external additives as developer usually does). Attached to this toner container 2 are the development roller 20, as a developer bearing member, for developing an electrostatic latent image formed on the photosensitive drum 10 into a visible image by supplying the electrostatic latent image with toner, and a regulating means 29 for regulating the thickness of the developer (toner) layer formed on the peripheral surface of the development roller 20 while frictionally charging the toner, etc. Attached to the bottom edge of the opening of the development chamber 13*a* of the developing means frame 13 is a toner blowout prevention sheet 25 for sealing the gap between the bottom edge and the peripheral surface of the development roller 20 in order to prevent the toner from blowing out through the gap. Therefore, the toner is prevented from leaking out of the developer container from the underside of the development roller 20.

As the stirring means 100 and 101 (first and second stirring means) are rotated, the toner in the toner container 21 is conveyed by the stirring means 100 and 101 toward the development roller 20, which internally holds a stationary magnet 28 around which it rotates, and as the development roller 20 is rotated, the toner is borne on the peripheral surface of the development roller 20. Then, as the development roller 20 is further rotated, the toner on the peripheral surface of the development roller 20 is frictionally charged by the aforementioned developer layer thickness regulating member 29*a* (blade), which is integral with, or glued to, the blade supporting portion 29*b* of the regulating means 29. As a result, the thickness of the toner layer on the development roller 20 is regulated to a predetermined value. The development roller 20 is provided with a pair of spacer rings 26, which are fitted around the lengthwise ends of the development roller 20, maintaining a predetermined clearance between the peripheral surfaces of the development roller 20 and the photosensitive drum 10. As the development roller 20 is further rotated, the portion of the developer layer on the peripheral surface of the photosensitive drum 10, the thickness of which has been regulated to the predetermined value, is conveyed to the development range of the peripheral surface of the photosensitive drum 10, in which the toner is supplied to the portion of the electrostatic latent image, on the portion, in the development range, of the peripheral surface or the photosensitive drum 10. In the development range, the toner on the peripheral surface of the development roller 20 is transferred onto the peripheral surface of the photosensitive drum 10 in the pattern of the electrostatic latent image on the photosensitive drum 10. As a result, a toner image is formed on the peripheral surface of the photosensitive drum 10. Located in the adjacencies of the peripheral surface of the development roller 20 is the developer stirring member 27 rotatably attached to the frame of the development unit in order to circulate the toner in the development chamber 13*a*.

The toner container 21 is made up of the developing means supporting frame 13, the toner container frame 24, and the developer container lid 23 (toner container lid), which are welded together by ultrasonic welding or the like means. The developing means supporting frame 13 supports the development roller 20, the regulating means 29, the developer stirring member 27, etc., and also, provides the development chamber 13*a* into which the toner is supplied. The toner container frame 24 has the developer storage portions (first and second toner storage portions 21*a* and 21*b*), which support the toner stirring means 100 and 101 (first and second stirring means) and internally hold the developer. The development roller 20, the regulating means 29, etc., supported by the developing means supporting frame 13 make up the developing means for developing an electrostatic latent image by supplying the toner to the peripheral surface of the photosensitive drum 10.

The photosensitive drum 10 on which an electrostatic latent image is formed, the charge roller 11 as a charging means for uniformly charging the peripheral surface of the photosensitive layer of the photosensitive drum 10, and the cleaning means for scraping the peripheral surface of the photosensitive drum 10 in order to scrape down the residual toner, that is, the toner remaining adhered to the peripheral surface of the photosensitive drum 10 without being transferred onto the recording medium 4, are supported by the drum supporting frame 9 of the photosensitive drum unit B. The drum supporting frame 9 has the waste toner storage portion 12 in which the waste toner, that is, the toner scraped down from the peripheral surface of the photosensitive drum 10 by the cleaning means 14, is stored. Further, the cleaning means container lid 16 is solidly fixed to the drum supporting frame 9, forming the cleaning means container 15.

Also referring to FIG. 1, the photosensitive drum 10 is rotationally driven in the clockwise direction (indicated by arrow mark Y1). To the charge roller 1, a predetermined amount of voltage is applied to uniformly charge the surface of the photosensitive layer of the photosensitive drum 10. The uniformly charged surface of the photosensitive drum 10 is exposed to the beam of laser light L projected onto the peripheral surface of the photosensitive drum 10 from the optical means 1 through the exposure opening 2 while being modulated with the image information. As a result, an electrostatic latent image is formed on the peripheral surface of the photosensitive drum 10. Thereafter, the electrostatic latent image is developed by the developing means. Consequently, a toner image is formed on the peripheral surface of the photosensitive drum 10.

To the transfer roller 3, as a toner image transferring means, with which the main assembly Pa of the image forming apparatus is provided, such voltage that is opposite in polarity to the toner image formed on the photosensitive drum 10, is applied to transfer the toner image onto the recording medium 4. Thereafter, the toner remaining on the peripheral surface of the photosensitive drum 10 is removed by the cleaning means 14. More specifically, the cleaning member 14*a* (cleaning blade) integrally formed of, or glued to, the blade supporting portion 14*b* of the cleaning means 14 is placed in contact with the peripheral surface of the photosensitive drum 10 so that the toner remaining on the peripheral surface of the photosensitive drum 10 is scraped down by the cleaning member 14*a* and collected into the waste toner storage portion 12.

Figure 19:
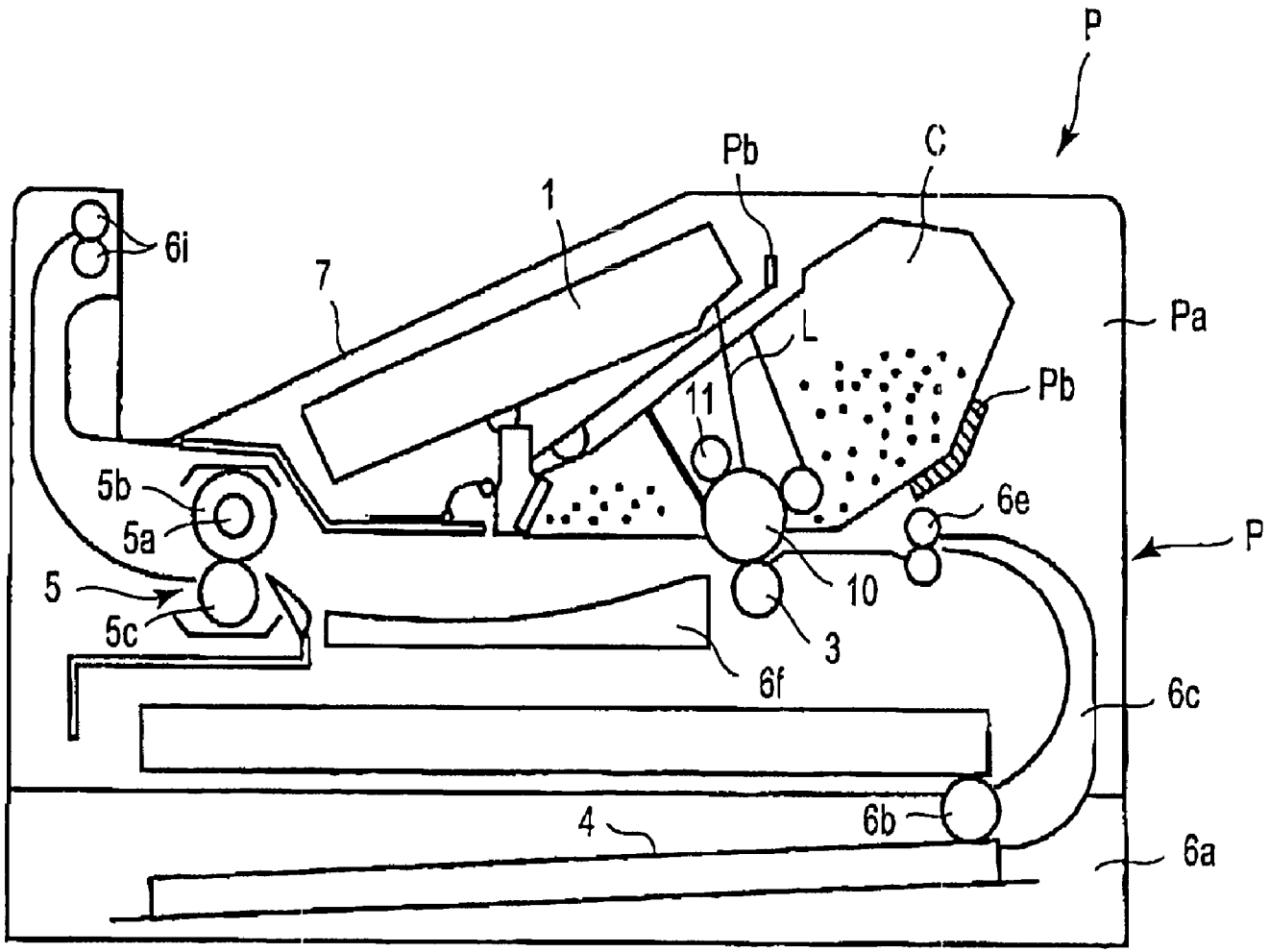
FIG. 19 is a sectional view of a typical electrophotographic image forming apparatus in accordance with the present invention, showing the general structure thereof.

The cartridge C is removably mounted in the apparatus main assembly Pa; it is removably guided into the apparatus main assembly Pa by the cartridge guiding members, cartridge positioning members Pb as cartridge mounting means (FIG. 19). As the cartridge C is properly mounted in the apparatus main assembly Pa, it becomes possible for the predetermined charge bias and development bias to be applied to the charge roller 11 and development roller 20 from the voltage applying means (unshown) with which the apparatus main assembly Pa is provided.

Also, as the cartridge is properly mounted in the apparatus main assembly Pa, the driving force transmitting portion (unshown) on the apparatus main assembly side becomes connected to the driving force transmitting portion (unshown) on the cartridge side, making it possible for the driving force to be transmitted from the driving means (unshown), such as a motor, with which the apparatus main assembly Pa is provided, to the cartridge C. In this embodiment, the driving force from the driving means of the apparatus main assembly Pa is transmitted to the photosensitive drum 10. Then, the same driving force is transmitted from the photosensitive drum 10 to the development roller 20, stirring means 100 and 101 (first and second stirring means), etc., by way of such a driving means as a gear train. Incidentally, the apparatus main assembly Pa may be provided with a driving means which is independent from the driving means for driving the photosensitive drum 10, and which is for exclusively driving, for example, the stirring means 100 and 101 (first and second stirring means), through the driving force transmitting portions provided on the apparatus main assembly and cartridge sides, one for one.

[Structure of Toner Container]

Next, referring to FIG. 2, the structure of the toner container 21 will be described further.

Figure 2:
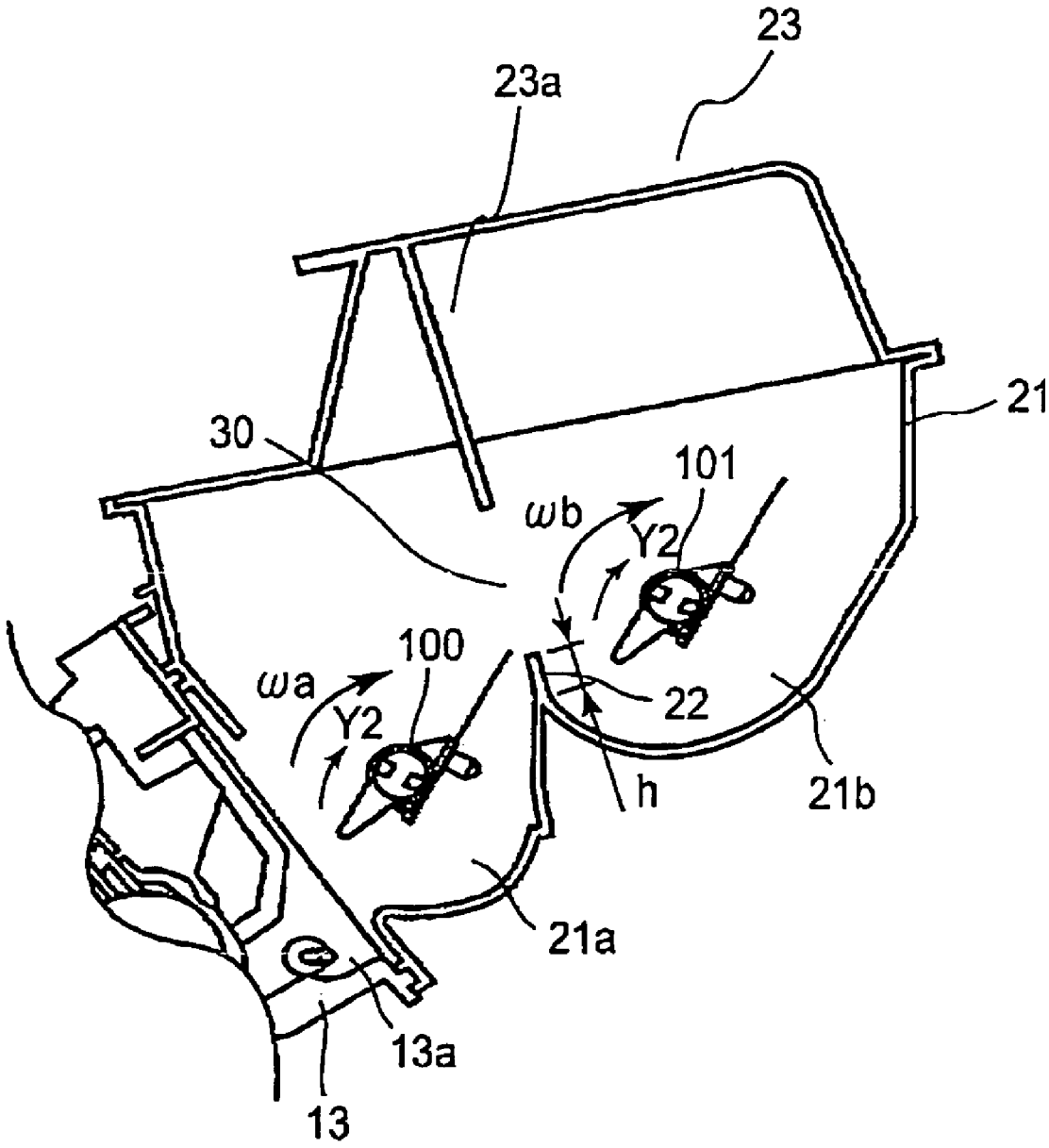
FIG. 2 is a vertical sectional view of the toner container portion of the process cartridge in the first embodiment.

As will be evident from FIG. 2, the toner container 21 essentially comprises the first and second toner storage portions 21*a* and 21*b* divided by the partitioning member 22, which extends a certain distance upward from the joint between the bottom walls of the first and second toner storage portions 21*a* and 21*b*, regulating the height to which the toner in the second toner storage portion 21*b* is swept upward as the toner is moved by the second stirring means 101 from the second toner storage portion 21*b* into the first toner storage portion 21*a* through the opening 30 between the first and second toner storage portions 21*a* and 21*b*. The opening 30 is the gap between the partitioning member 22 and the rib 23*a* extending from the toner container lid 23. The height h of the partitioning member 22 is set to a value in accordance with the condition which the cartridge design must meet to prevent the problem that as the toner in the toner storage portion 21*b* is sent into the first toner storage portion 21*a* by an excessive amount, the toner in the first toner storage portion 21*a* becomes agglomerated.

In the first and second toner storage portions 21*a* and 21*b*, the stirring means 100 and 101 (first and second stirring means) are placed, respectively. The first stirring means 100 on the downstream side, or the one closer to the development roller 20, is positioned so that when the cartridge C is in its image forming position in the apparatus main assembly Pa, it will be positioned lower than the second stirring means 101. With the provision of this structural arrangement, the weight of the toner itself can be used to smoothly convey the toner as soon as the toner is moved past the opening 30.

[Stirring Means]

Referring to FIGS. 3–9, the stirring means 100 and 101 (first and second stirring means) will be described. Here, the stirring means will be described with reference to the second stirring means 101. The first stirring means 100 is virtually the same in structure as the second stirring means 101.

The stirring means 101 comprises a stirring member 110 as a first stirring member solidly fixed to the rotational axis of the stirring means 101, and a stirring member 111 as a second stirring member rotatable relative to the stirring member 110. Next, as will be described in detail hereinafter, in this embodiment, the stirring member 110 comprises a shaft (rotational shaft) 110*a,* and multiple projections 110*b* as actual toner stirring portions solidly attached to the shaft 110*a*. The projections 110*b* project from the cylindrical portion 110*a* in the radius direction of the shaft 110*a*. The stirring member 111 comprises: a cylindrical portion 111*a* by which the stirring member 111 is connected to the stirring member 110: an elastic sheet mount 111*g* extending in the lengthwise direction of the cylindrical portion 111*a,* and also, projecting in the radius direction of the cylindrical portion 111*a;* and an elastic sheet 112 as an actual stirring portion attached to the elastic sheet mount 111*g*. The stirring member 110 begins to stir the toner before the stirring member 111 begins to stir the toner. The stirring member 111 is driven by the stirring member 110.

As will become evident from the following description, according to this embodiment, the stirring member 110 can efficiently stir the agglomerated toner by its rotational movement. That is, in the relatively short length of time prior to the starting of the driving of the stirring member 111, the stirring member 110 efficiently stirs the toner, assuring that the toner will be efficiently conveyed by the string means 101 while being stirred by the stirring means 101. The sweeping range of the stirring member 110 slightly overlaps with that of the stirring member 111, stirring therefore at least some of the developer in the sweeping range of the stirring member 111, that is, the developer in the area where the sweeping ranges of the stirring members 110 and 111 overlap. It is preferable that the two stirring members 110 and 111 sweep roughly the same range in terms of the lengthwise direction. With the provision of the above-described structural arrangement, prior to the starting of the normal toner conveying-stirring operation by the stirring members 110 and 111, the agglomerated toner is efficiently stirred, preferably, across roughly the entirety of the sweeping range of the stirring member 101, reducing thereby the amount of the torque necessary for the stirring means 101 to begin conveying the toner while stirring it.

Figure 3:
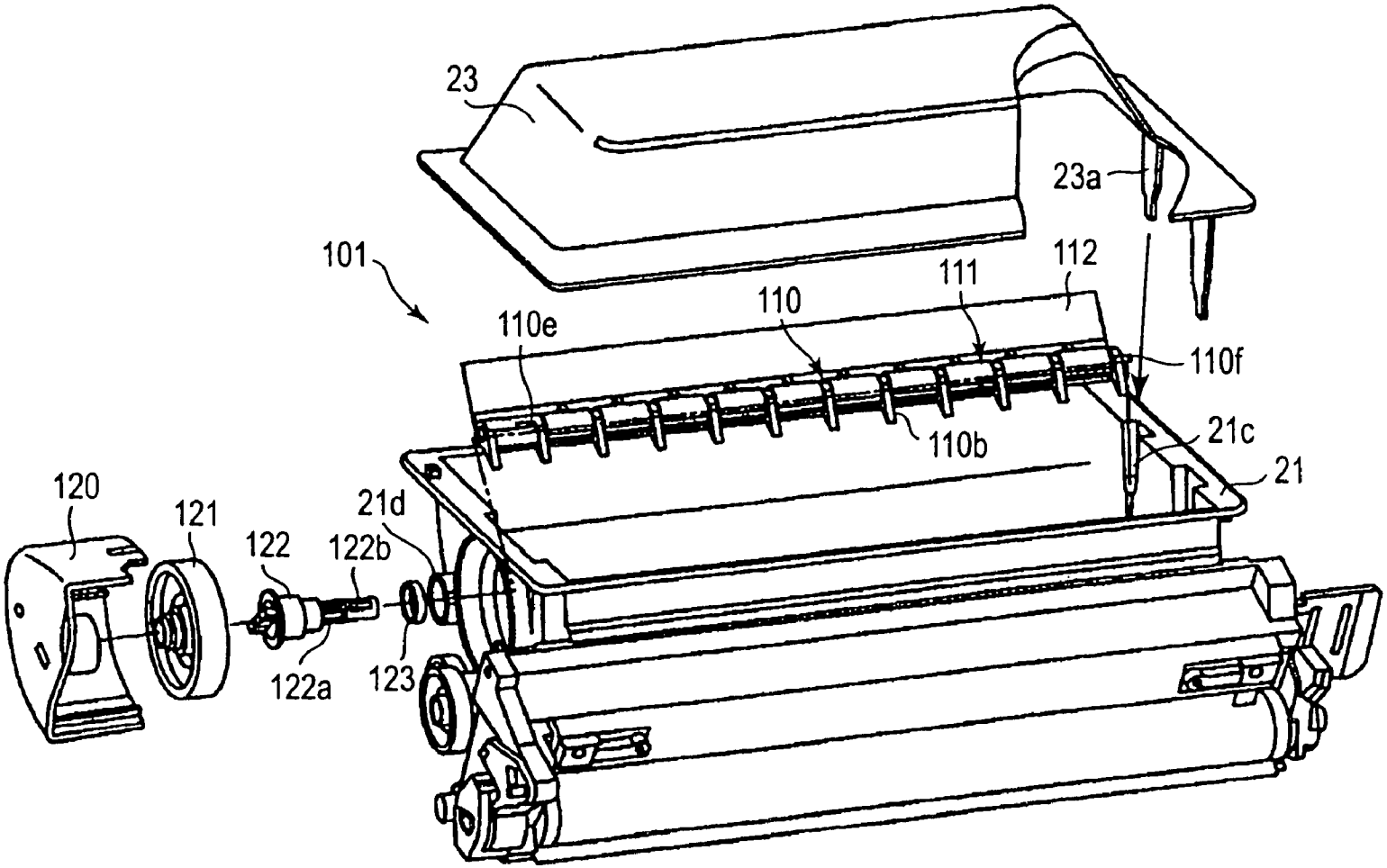
FIG. 3 is an exploded perspective view of the process cartridge in the first embodiment, showing how the stirring means is attached to the frame of the process cartridge in the first embodiment.

Referring to FIG. 3, one of the lengthwise ends of the stirring member 110 is fitted with a coupling member 122 as a driving force transmitting means, which is put through the bearing hole 21*d* (the wall of which serves as bearing) of the toner container 21, from outside of the toner container 21, being thereby supported by the toner container 21. As for the fitting of the stirring member 110 with the coupling member 122, the shaft 122*a* of the coupling member 122 having a double D cross-section, is fitted into the hole of the lengthwise end of the stirring member 110 having the double D cross-section, and the locking claw 122*b* of the coupling member 122 locks into the locking hole 110*e* of the stirring member 110. The gap between the coupling member 122 and the wall of the hole 21*d* is sealed with a sealing member 123, thereby preventing the toner from leaking from the toner container 21.

The other lengthwise end of the stirring member 110 is a shaft 110*f,* which is fitted in the bearing groove 21*c* of the toner container 21. The toner container lid 23 is provided with a pair of retainer ribs 23*a,* which keep the shaft 110*f* of the stirring member 110 held to the toner container 21 after the solid attachment of the toner container lid 23 to the toner container 21 by ultrasonic welding or the like method.

Located outward of the coupling member 122 in terms of the lengthwise direction is a stirring means driving gear 121 as a driving force transmitting means supported by the side cover 120. The driving gear 121 transmits to the coupling member the driving force transmitted thereto through a gear train (unshown).

Figure 4:
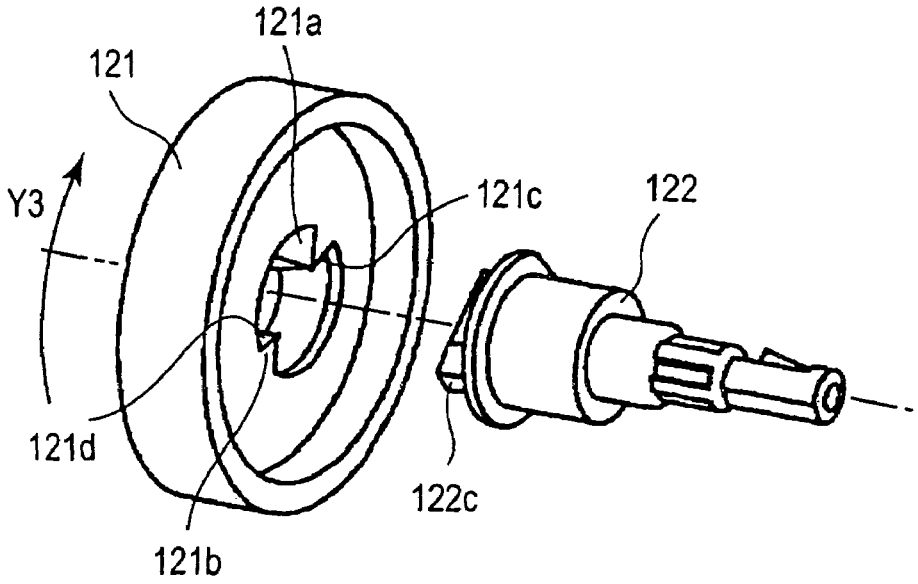
FIG. 4 is an exploded perspective view of the coupling portion of the driving system for the stirring means.

To describe further the coupling portion with reference to FIG. 4, the stirring means driving gear 121 is provided with a pair of driving force transmitting projections 121*a* and 121*b,* whereas the coupling member 122 is provided with a driving force transmitting rib 122*c* the stirring means driving gear 121 and coupling member 122 are positioned relative to each other so that their rotational axes virtually coincide. As the stirring means driving gear 121 is rotated (in the direction indicated by arrow mark Y3), the driving force transmitting surfaces 121*c* and 121*d* of the pair of driving force transmitting projections 121*a* and 121*b,* respectively, come into contact with the driving force transmitting surfaces of the coupling member 122, making it possible for the driving force to be transmitted from the stirring means driving gear 121 to the coupling member 122.

Figure 5:
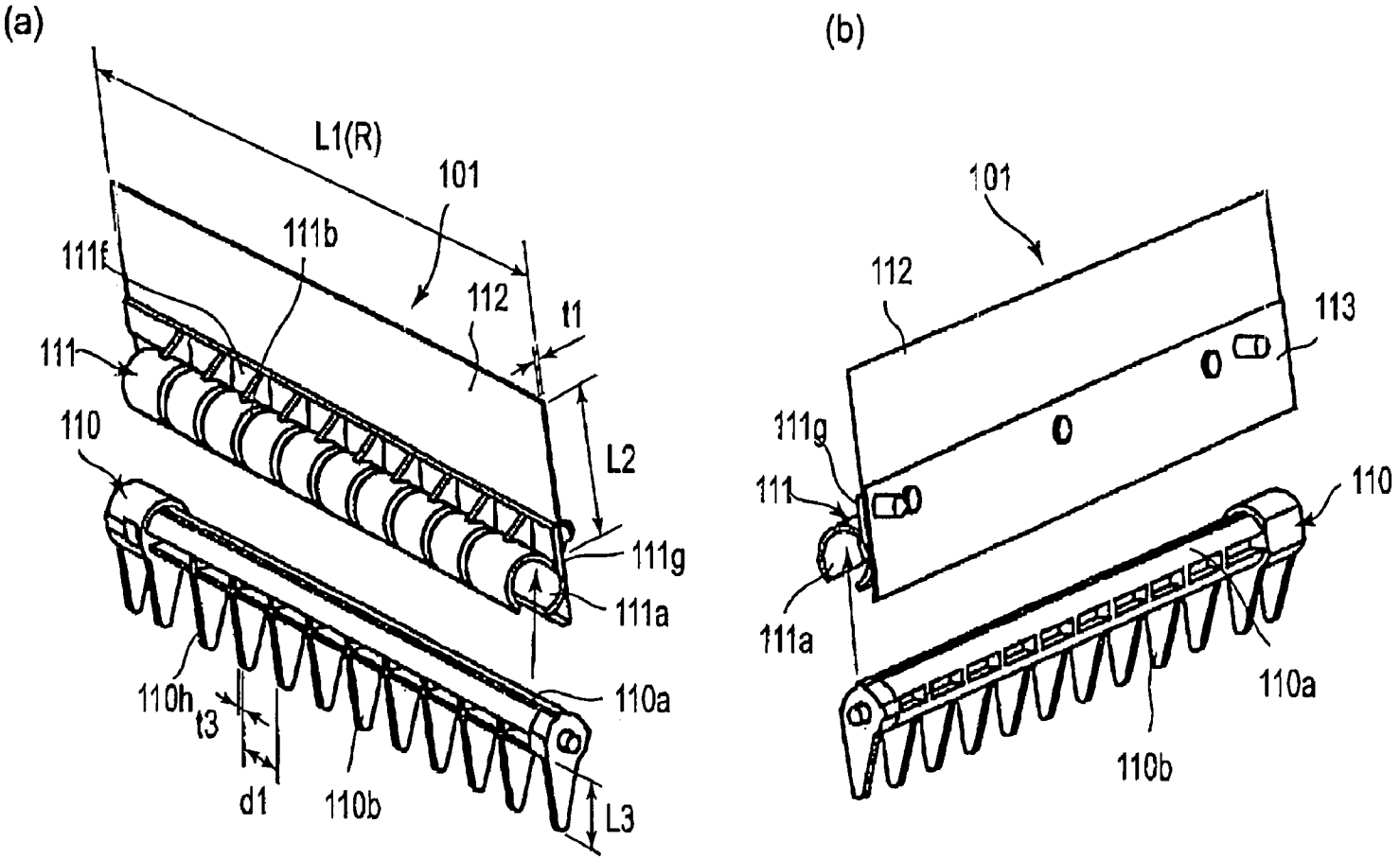
FIGS. 5(*a*) and 5(*b*) are exploded perspective views of the stirring means.

FIGS. 5(*a*) and 5(*b*) depict the stirring means 101 in more detail. In this embodiment, each of the projections 110*b* as actual stirring portions of the stirring member 110 is thin (t3 in thickness) in terms of the lengthwise direction of the stirring member 110 (direction parallel to rotational axis of stirring member 110), and its dimension in terms of the direction intersecting (perpendicular, in this embodiment) the rotational axis of the stirring member 110, is L3. The projection 110*b* has flat surfaces roughly perpendicular to the lengthwise direction of the stirring member 110, and flat surfaces roughly parallel to the lengthwise direction of the stirring member 110. Also in this embodiment, all the projections 110*b* are located in roughly the same position in terms of the rotational direction of the stirring means 101, and are aligned in parallel roughly in a straight line in the lengthwise direction of the stirring member 110, with predetermined intervals, projecting from the shaft portion 110*a*. The projections 110*b* are formed of resin, and are integrally formed with the shaft portion 111*a*. The projections 110*b* are made rigid enough not to be flexed by the pressure applied thereto by the toner stirring operation.

The intervals of the projections 110*b* of the stirring member 110 in terms of the lengthwise direction of the stirring member 110 may be set so that the desired stirring effect can be achieved. It is preferable, however, that, in order to enable the stirring member 110 to stir the toner across the entirety of the range R, in terms of the lengthwise direction of the stirring member 111, across which the toner can be stirred, at virtually the same time, the stirring member 110 is provided with a predetermined number of projections 110*b* positioned at predetermined intervals.

The stirring member 111 is provided with the elastic sheet 112 as a stirring portion, which is L1 in the dimension in terms of lengthwise direction of stirring member, L2 in the dimension in terms of the radius of its sweeping range, and t1 in thickness. The elastic sheet 12 is attached to the mount 111*g* with the use of an elastic sheet retaining member 113 which is fixed to the mount 111*g* by gluing, welding, or thermal crimping, or is solidly fixed to the mount 111*g* with the use of small screws. In other words, the elastic sheet 112 is held to the stirring member 111 by being kept pinched between the mount 111*g* and elastic sheet retaining member 113. In this embodiment, PPS (polyphenylene sulfide) is used as the material for the elastic sheet 112.

The measurements of the elastic sheet 112 are as follows:

Thickness t1 of elastic sheet 112: 100 μm

Length L1 of elastic sheet 112: 213 mm (in terms of the direction parallel to the lengthwise direction of the stirring member)

Length L2 of elastic sheet 112: 23.5 mm (in terms of the radius direction of the sweeping range of the elastic sheet)

In the hollow of the cylindrical portion 111*a* of the stirring member 111, the shaft portion 110*a* of the stirring member 110 is rotatably fitted. Further, the cylindrical portion 111*a* of the stirring member 111 is provided with a slit 111*b* for accommodating the projections 110*b* of the stirring member 110.

Figure 6:
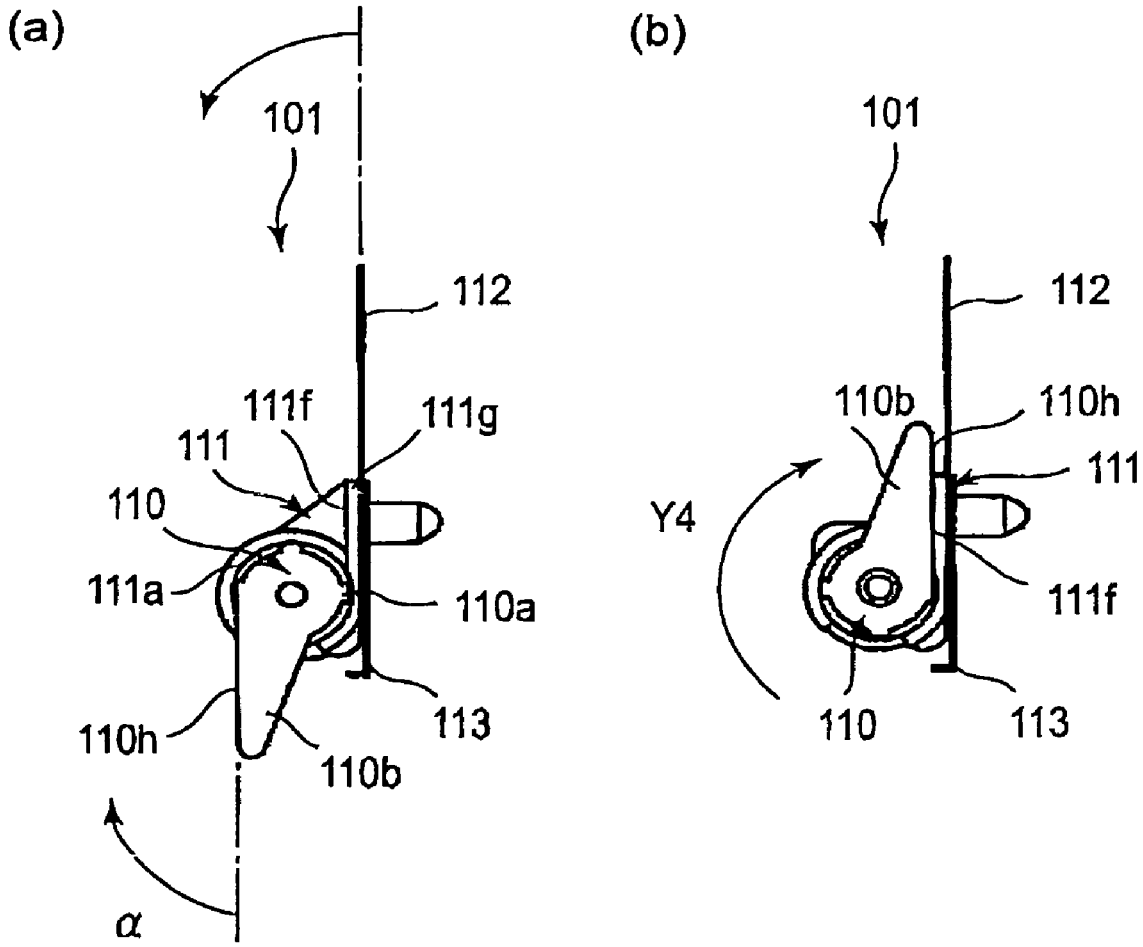
FIGS. 6(*a*) and 6(*b*) are side views of the stirring means.

The projections 110*b* of the stirring member 110, and the elastic sheet 112 secured to the mount 111*g* of the stirring member 111, are made different in rotational phase as shown in FIG. 6(*a*). The amount of the pressure to be applied to fit the shaft portion 110*a* of the stirring member 110 into the hollow of the cylindrical portion 111*a* of the stirring member 111 is made to be relatively small. The difference in rotational phase set between the projections 110*b* of the stirring member 110 and the elastic sheet 112 of the stirring member 111 at the time of assembly can be maintained by the friction between the cylindrical portion 111*a* of the stirring member 111 and the shaft portion 110*a* of the stirring member 110. The angle α (FIG. 6) by which the stirring member 110 rotates from its initial position to the point at which it begins to drive the stirring member 111 should be properly set for fully loosening the agglomerated developer prior to the starting of the stirring movement of the stirring member 111. According to the studies made by the inventors of the present invention, the angle α is desired to be in the range of 180°–360°, preferably, 270°–360°. In other words, by setting the angle α to a value within the above-described ranges, the toner within the range in which the elastic sheet 112 begins to rotate is conveyed by the projections 110*b* in the clockwise direction (indicated by arrow mark in FIG. 6(*b*)), or the direction in which the elastic sheet 112 is rotated. Thus, the amount of the mechanical resistance which the agglomerated toner generates as the elastic sheet 112 begins to stir the toner is substantially reduced. As a result, the amount of torque necessary to drive the stirring means 101 is reduced.

In this embodiment, when the projections 110*b* as the actual toner stirring portions of the stirring member 110 are in the initial positions, the direction in which they extend is roughly parallel to the direction in which the elastic sheet 112 extends in terms of the radius direction of its sweeping range. However, the direction in which the projections 110*b* extend from the shaft portion 110*a* of the stirring member 110 is opposite to the direction in which the elastic sheet 112 extends from the mount 111*g* of the stirring member 111 (α≈180°).

Next, referring to FIG. 6, when there is a substantial amount of toner in the toner container 21, the contact area between the stirring member 111 and the body of toner in the toner container is substantially greater than the overall contact area between the toner and the stirring member 110. Therefore, when there is a substantial amount of toner in the toner container 21, the amount of the mechanical resistance which the toner generates against the stirring member 111 as the stirring member 111 is rotated is substantially greater than the amount of the mechanical resistance the toner generates against the stirring member 110 as it is rotated. Further, the friction between the shaft portion 110*a* of the stirring member 110 and the cylindrical portion 111*a* of the stirring member 111 is relatively small as described above. Therefore, as the stirring means 101 begins to be rotationally driven, the stirring member 110, which requires a relatively smaller amount of torque to rotate, begins to rotate while loosening the toner with its projections 110*b,* before the stirring member 111.

Then, the contact portion (surface of projection 110*b* facing downstream in terms of rotational direction of stirring member 110) 110*h* of the stirring member 110 comes into contact (FIG. 6(*b*)) with the contact portion (surface of mount 111*g* facing upstream in terms of rotational direction of stirring member 111) 111*f* of the stirring member 111. As a result, the stirring means driving force is transmitted to the stirring member 111, causing the stirring member 111 to stir the toner. At this point in time, the toner has already been loosened by the stirring member 110, having therefore been reduced in mechanical resistance. Therefore, the amount of the, torque necessary to rotate the stirring means 101 having the stirring member 110 at the startup is much smaller than that necessary to rotate the stirring member 101 having no stirring member 110. After the initial contact between the contact portion 110*h* of the stirring member 110 and the contact portion 110*f* of the stirring member 110, the stirring members 110 and 111 rotate together.

With the provision of the above-described structural arrangement, the amount of the torque necessary to stir the agglomerated toner can be substantially reduced.

In this embodiment, the difference in rotational phase between the stirring member 110 and 111, which is set during the assembly of the stirring means 101 (cartridge C), is maintained by the friction between the shaft portion 110*a* of the stirring member 110 and the cylindrical portion 111*a* of the stirring member 111 configured so that the former can be fitted into the latter with the application of a relatively small amount of pressure. However, it may be maintained with the use of a locking claw as shown in FIG. 7.

Figure 7:
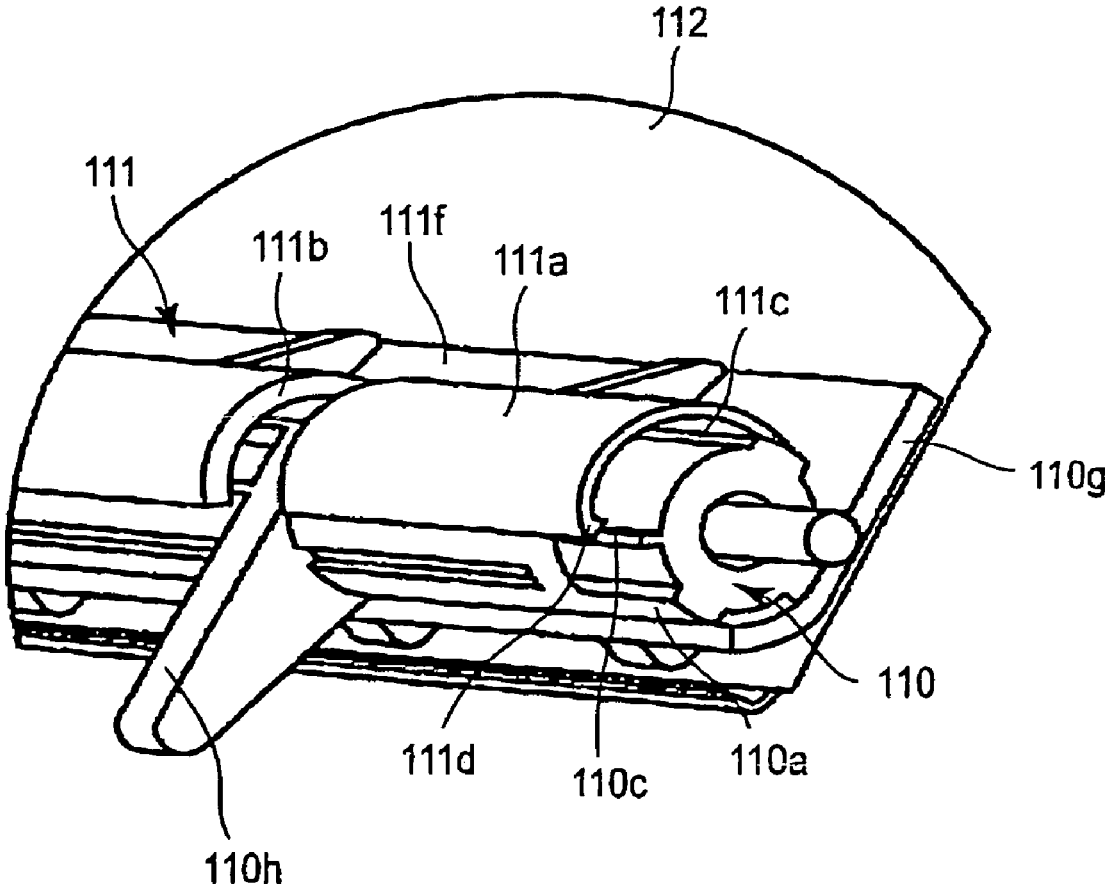
FIG. 7 is a perspective view of the means for controlling the rotational phases of the stirring members.

As will be evident from FIG. 7, the cylindrical portion 111*a* of the stirring member 111 is provided with a groove 111*c* and a locking claw 111*d,* whereas the shaft portion 111*a* of the stirring member 110 is provided with a locking projection or claw 110*c*.

When there is no toner, the locking claw 111*d* remains locked with the locking projection 110*c* of the stirring member 110, maintaining a predetermined amount of difference in rotational phase between the stirring member 110 and stirring member 111. When lo there is toner, however, as the stirring member 110 begins to be driven, the locking claw 110*c* rides over the locking claw 111*d,* allowing the stirring member 110 begin stirring the toner while changing the difference in rotational phase between the stirring member 110 and stirring member 111. Thereafter, the contact portion 110*h* of the stirring member 110 comes into contact with the contact portion 111*f* of the stirring member 111, causing the stirring member 111 to begin stirring the toner. Thereafter, the stirring member 110 and stirring member 111 rotate together.

Figure 8:
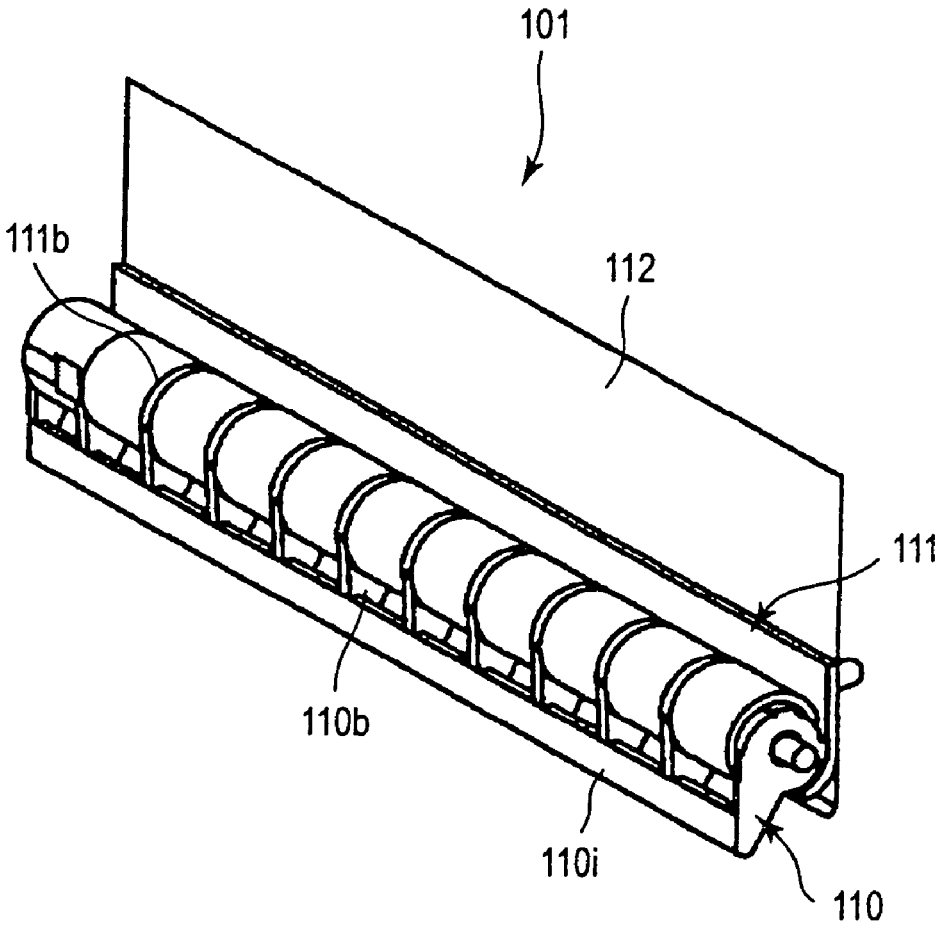
FIG. 8 is a perspective view of a stirring means different in structure from that shown FIG. 7.

Incidentally, for the purpose of improving the stirring member 110 in stirring efficiency, all the projections 110*b* may be connected by the connective member 110*i* which extends in the lengthwise direction of the stirring member 110 (FIG. 8).

Figure 9:
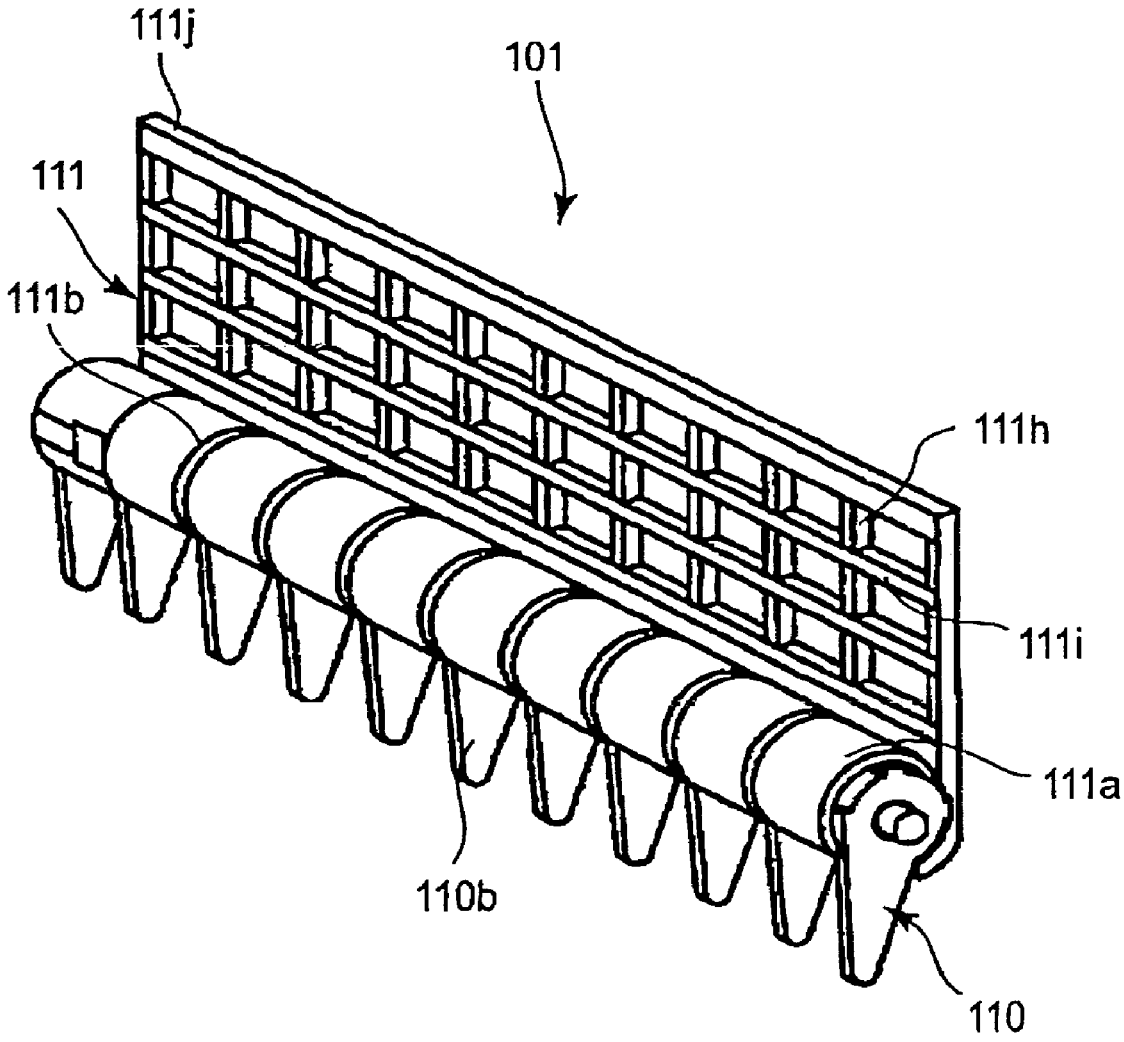
FIG. 9 is a perspective view of a stirring member different in structure from those shown in FIGS. 8 and 7.

Further, instead of the elastic sheet 112 or the like, a piece of board, projections, a ladder-like member, or the like, may be attached as the actual toner stirring portions of the stirring member 111. These actual toner stirring portions different in shape may be solidly fixed to the cylindrical portion 111*a,* or integrally formed therewith. FIG. 9 shows one of such examples: a stirring member 111 comprising the cylindrical portion 111*a*, and a ladder 111*j* integrally formed therewith and made up of the vertical members 111*h* and horizontal members 111*i*.

At this time, the rotational velocity of the first and second stirring means 100 and 101 will be described. Referring to FIG. 2, the first stirring means 100 rotates in the direction (indicated by arrow mark Y2) to send the toner into the developing means supporting frame 13, whereas the second stirring means 101 rotates in the direction (indicated by arrow mark Y2) to send the toner into the first toner storage portion 21*a* through the opening 30. The angular velocities ωa and ωb of the first and second stirring means 100 and 101 are set so that the inequality: ωa>ωb is satisfied; in other words, the angular velocity ωa of the first stirring means 100, or the downstream stirring means, is made greater than the angular velocity ωb of the second stirring means 101, making it easier for the toner to be supplied to the development roller 20. In comparison, the angular velocity ωb of the second stirring means, or the upstream stirring means being farther away from the developing means supporting frame 13, is made as slow as possible within the range in which the toner can be moved into the first toner storage portion 21*a*.

With the provision of the above-described setup, it is possible to prevent the toner deterioration which might occur as the toner is excessively stirred in the area distant from the development roller 20.

When the first and second stirring means 100 and 101 are not synchronized initially, the angular velocities ωa and ωb are desired to be set so that the former does not become a multiple of the latter, in order to prevent the stirring means 100 and 101 from always remaining synchronizing in rotational phase.

As described above, in the case of the cartridge C in this embodiment, even if the developer in the cartridge C becomes agglomerated due to the vibrations which occur during shipment, or becomes settled due to the weight of the toner itself, it requires a much smaller amount of torque to stir the agglomerated or settled toner to loosen it, compared to a cartridge in accordance with the prior art. In other words, the cartridge C in this embodiment is much smaller in the amount of the torque required at startup than a cartridge in accordance with the prior art. Therefore, it is possible to reduce in thickness of the gears of the drive train of the apparatus, or reduce in capacity the motor of the apparatus, making it thereby possible to reduce in size the apparatus.

Embodiment 2

Next, referring to FIGS. 10(*a*) and 10(*b*), the second embodiment of the present invention will be described. The elements in this embodiment, which are virtually identical or equivalent to those in the first embodiment are given the same reference symbols given in the first embodiment, and will not be described in detail. This convention will be the same throughout the rest of this specification.

In this first embodiment, when the projections 110*b* as actual stirring portions of the stirring member 110 are at their initial positions, the direction in which they extend is virtually parallel to the surface of the elastic sheet 112 as the actual stirring portion of the stirring member 111 (α≈180°), and is opposite to the direction in which the elastic sheet 112 extends from the mount 111*g*.

Figure 10:
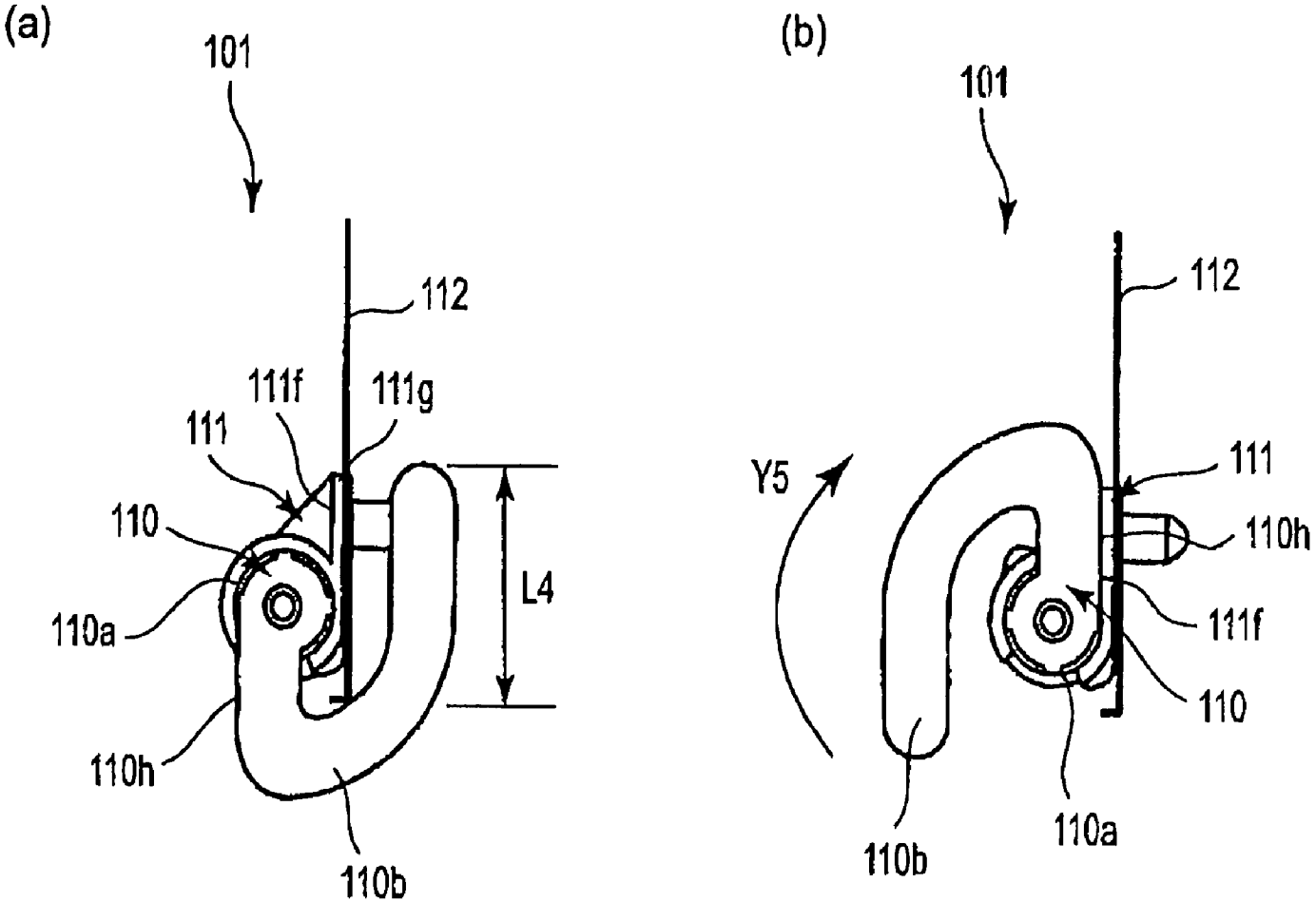
FIGS. 10(*a*) and 10(*b*) are side views of one the projections of the solid stirring member in the second embodiment of the present invention.

Referring to FIG. 10(*a*), in this embodiment, the projections 110*b* as the actual stirring portions of the stirring member 110 are extended into the downstream adjacencies of the stirring member 111 in terms of the rotational direction of the stirring member 111. To describe this feature in more detail, when the projections 110*b* of the stirring member 110 are in their initial positions, the base portions thereof extend virtually parallel to the surface of the elastic sheet 112 of the stirring member 111, in the direction opposite to the direction in which the elastic sheet 112 extends, as the projections 110*b* of the stirring member 110 extend in the first embodiment, and the mid portions of the projections 110*b* bend upstream, in terms of the rotational direction of the stirring means 101, in a manner to wrap around the elastic sheet mount 111*g* of the stirring member 111. The end portions of the projections 110*b* extend parallel to the surface of the elastic sheet 112, in the same direction as does the elastic sheet 112. With the provision of the above-described structural arrangement, the toner in the range in which the elastic sheet 112 begins to rotate is conveyed by the projections 110*b* in the rotational direction of the elastic sheet 112, that is, the clockwise direction (indicated by arrow mark Y5 in FIG. 10(*b*)), thereby reducing the amount of mechanical resistance which the toner generates against the elastic sheet 112 as it is rotated. Therefore, it is possible to reduce the amount of the torque necessary to drive the stirring means 101. Incidentally, the thicknesses of the projections 110*b*, the positions thereof relative to the stirring member 110 in terms of the lengthwise direction of the stirring member 110, and the like properties, are the same as those in the first embodiment.

With the provision of the above-described structural arrangement, as the stirring means 101 is driven, the stirring member 110, which requires a relatively smaller amount of torque to rotate it, begins to rotate, stirring the toner, before the stirring member 111. Then, the contact portion 110*h* (surface of projection 110*b* facing downstream in terms of rotational direction of stirring member 110) of the stirring member 110 comes into contact (FIG. 10(*b*)) with the contact portion 111*f* (surface of mount 111*g* facing upstream in terms of rotational direction of stirring member 111) of the stirring member 111. As a 1s result, the stirring member 111 begins to stir the toner. In this embodiment, the end portions of the projections of the stirring member 110 are extending to the downstream adjacencies of the elastic sheet 112 fixed to the stirring member 111, in terms of the rotational direction of the stirring member 111. Therefore, the range across which the stirring member 110 loosens the toner is greater than that in the first embodiment. Therefore, the amount of the mechanical resistance the toner generates against the stirring member 111 as it stirs the toner is smaller than that in the first embodiment. Therefore, the amount of the torque required to stir the toner during the startup period is smaller than that in the first embodiment, making it possible to further reduce the amount of the torque necessary during the startup period, compared to that required by the toner conveying-stirring means in accordance with the prior art.

As described above, according to the present invention, the amount of the mechanical resistance the toner generates against the toner conveying-stirring means at the startup of the developing apparatus can be further reduced, making it possible to further reduce the amount of the torque necessary to start up a developing apparatus for the first time.

Embodiment 3

Next, referring to FIGS. 11, 12(*a*), and 12(*b*), the third embodiment of the present invention will be described.

Figure 11:
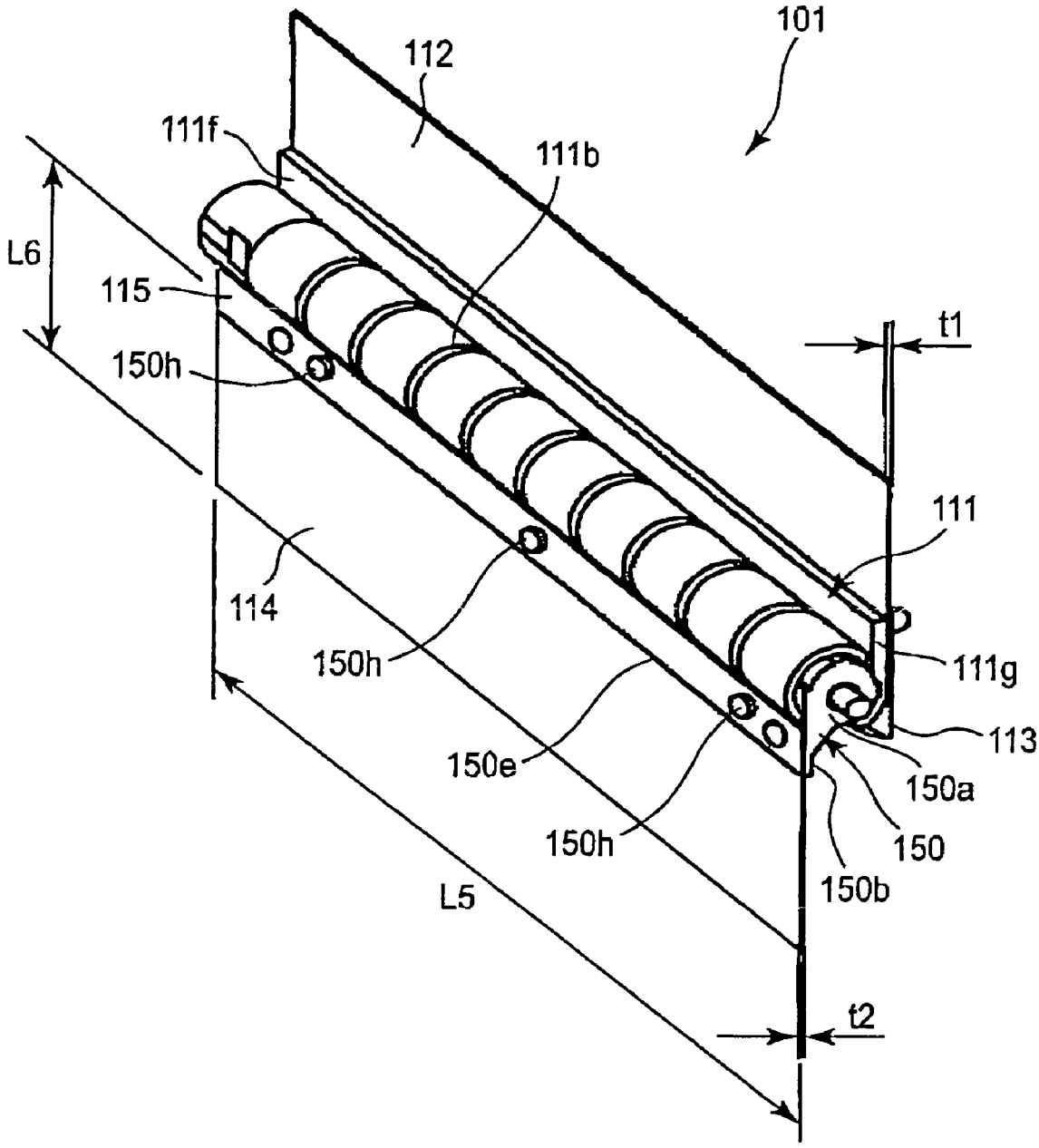
FIG. 11 is a perspective view of the stirring means in the third embodiment of the present invention.

Referring to FIG. 11, in this embodiment, the stirring member 150, as the first stirring member of the stirring means 101, has a shaft portion 150*a*, an elastic sheet mount 150*e*, and an elastic sheet 114. The mount 105*e* is where the elastic sheet 114, as the actual stirring portion of the stirring means 101, is attached. It projects from the shaft portion 150*a* in the radius direction of the shaft portion 150*a*, and its dimension in terms of the lengthwise direction of the stirring member 150 matches that of the elastic sheet 114. The shaft portion 150*a* is provided with a pair of projections 150*b*, which project from the shaft portion 150*a*, and the mount 150*e* extends in the lengthwise direction of the stirring member 150 in a manner to connect the two projections 150*b*. The elastic sheet 114 is attached to the mount 150*e* with the use of an elastic sheet retaining member 115 which is fixed to the mount 150*e* by gluing, welding, or thermal crimping, or is solidly fixed to the mount 150*e* with the use of small screws in other words, the elastic sheet 114 is held to the stirring member 150 by being kept pinched between the mount 150*e* and the elastic sheet retaining member 115. In this embodiment, PPS (polyphenylene sulfide) is used as the material for the elastic sheet 114.

The stirring means 101 has a stirring member 111 as a second stirring member which is the same in structure as the one in the first embodiment.

Figure 12:
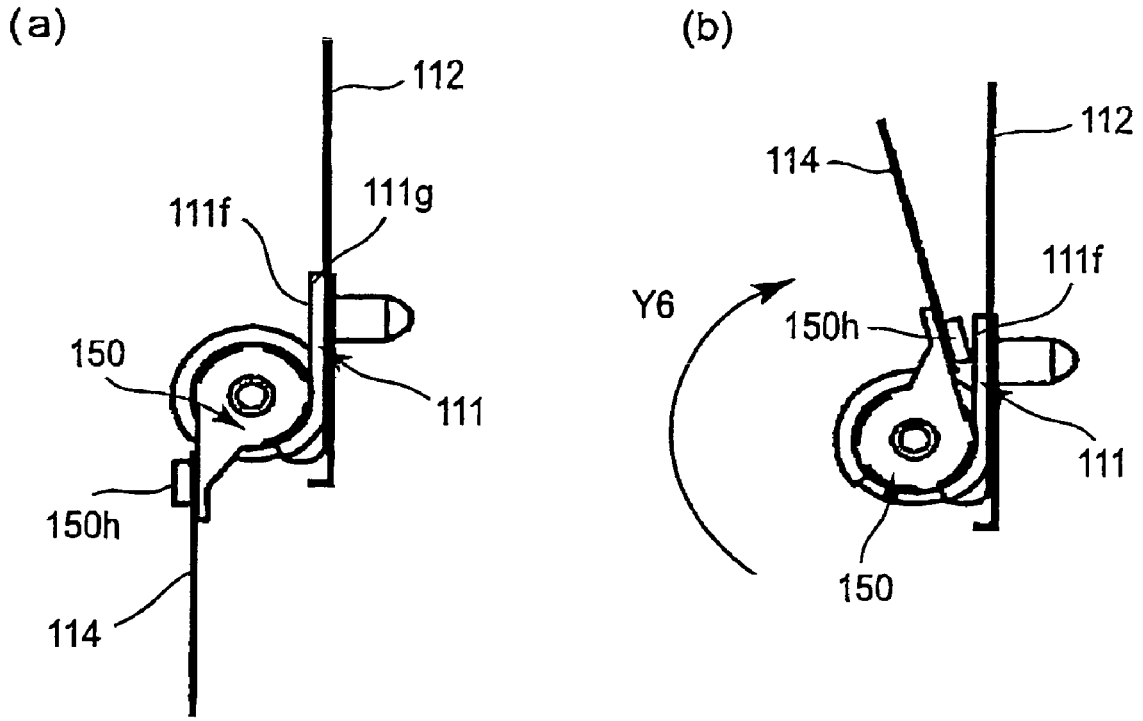
FIGS. 12(*a*) and 12(*b*) are side views of the stirring member in the third embodiment of the present invention.

Referring to FIG. 12(*a*), when the elastic sheet 114 fixed to the stirring member 150 is in its initial position, it is virtually parallel to the surface of the elastic sheet 112 fixed to the stirring member 111 ($\alpha \approx 180°$), and extends in the direction opposite to the direction in which the elastic sheet 112 extends from the rotational axis 150*a*.

In this embodiment, the dimension L5 of the elastic sheet 114 in terms of the lengthwise direction of the stirring member 150, and the dimension L6 of the elastic sheet 114 in terms of the radius direction of the rotational shaft 150*a*, are roughly the same as those L1 and L2 of the elastic sheet 112 of the stirring member 111, respectively. Further, the stirring member 150 and stirring member 111 are roughly the same in their sweeping areas. The thickness t1 of the elastic sheet 112 fixed to the stirring member 111 and the thickness t2 of the elastic sheet 114 fixed to the stirring member 150 are set so that an inequality: t1>t2 is satisfied. With the provision of the above-described structural arrangement, the elastic sheet 114 fixed to the stirring member 150 is more flexible than the elastic sheet 112 fixed to the stirring member 111, being therefore smaller in the toner resistance.

The measurements of the elastic sheet 112 of the stirring member 111 are as follows:

Thickness t1 of elastic sheet 112: 100 μm

Dimension L1 of elastic sheet 112: 213 mm (in terms of the direction parallel to the lengthwise direction of the stirring member).

Dimension L2 of elastic sheet 112: 23.5 mm (in terms of the radius direction of the sweeping range of the elastic sheet).

The measurement of the elastic sheet 114 of the stirring member 150 are as follows:

Thickness t1 of elastic sheet 114: 50 μm

Dimension L1 of elastic sheet 114: 213 mm (in terms of the direction parallel to the lengthwise direction of the stirring member)

Dimension L2 of elastic sheet 114: 23.5 mm (in terms of the radius direction of the sweeping range of the elastic sheet).

As the stirring means 101 structured as described is driven, the stirring portion 150 smaller in the torque necessary to drive it begins to rotate, stirring the toner, before the stirring member 111. Then, the contact portion 150*h* (a surface of retaining member 115 facing downstream in terms of rotational direction of stirring member 150, a projection with which this surface is provided, or small screws with which the retaining member 115 is held) of the stirring member 150 comes into contact with the contact portion 111*f* (the surface of the mount 111*g* facing upstream in terms of the rotational direction of the stirring member 111) of the stirring member 111, thereby causing the stirring member 111 to stir the toner (direction indicated by arrow mark Y6 in FIG. 12(*b*)). At this point in time, the toner has already been loosened by the stirring member 150, having therefore been reduced in mechanical resistance. Therefore, the amount of the torque necessary to rotate the stirring means 101 having the stirring member 150 at the startup is much smaller than that necessary to rotate the stirring, member 101 having no stirring member 150.

Also in the case of the structural arrangement in this embodiment, the stirring member 150 is structured so that the toner resistance against the stirring member 150 is smaller than that against the stirring member 111, and the stirring member 150 is made to begin stirring the toner before the stirring member 111 does. Therefore, the agglomerated toner is loosened by the stirring member 150 before the stirring member 111 begins stirring the toner. Therefore, the same effects as those realized in the preceding embodiments can be realized. Further, the stirring member 150 in this embodiment stirs the toner across virtually the entirety of the range R across which the stirring member 111 stirs the toner, before the stirring member 111 begins to stir the toner. Therefore, the agglomerated toner can be better loosened by the stirring means in this embodiment than by the stirring means in the preceding embodiments.

Embodiment 4

Next, referring to FIG. 13, the fourth embodiment of the present invention will be described.

The efficiency with which the agglomerated toner can be loosened by the stirring means in the first and second embodiments can be increased by increasing the thickness t3 of each of the projections 110*b* of the stirring member 110 (to roughly 2.5 mm, for example) in terms of the lengthwise direction of the stirring member 110 (direction parallel to rotational axis thereof), and/or increasing the number of the projections 110*b* (in other words, reducing interval d1 between adjacent two projections 110*b*). However, such a modification increases the toner resistance against the stirring member 110 while increasing the efficiency with which the agglomerated toner is loosened by the stirring member 110.

Figure 13:
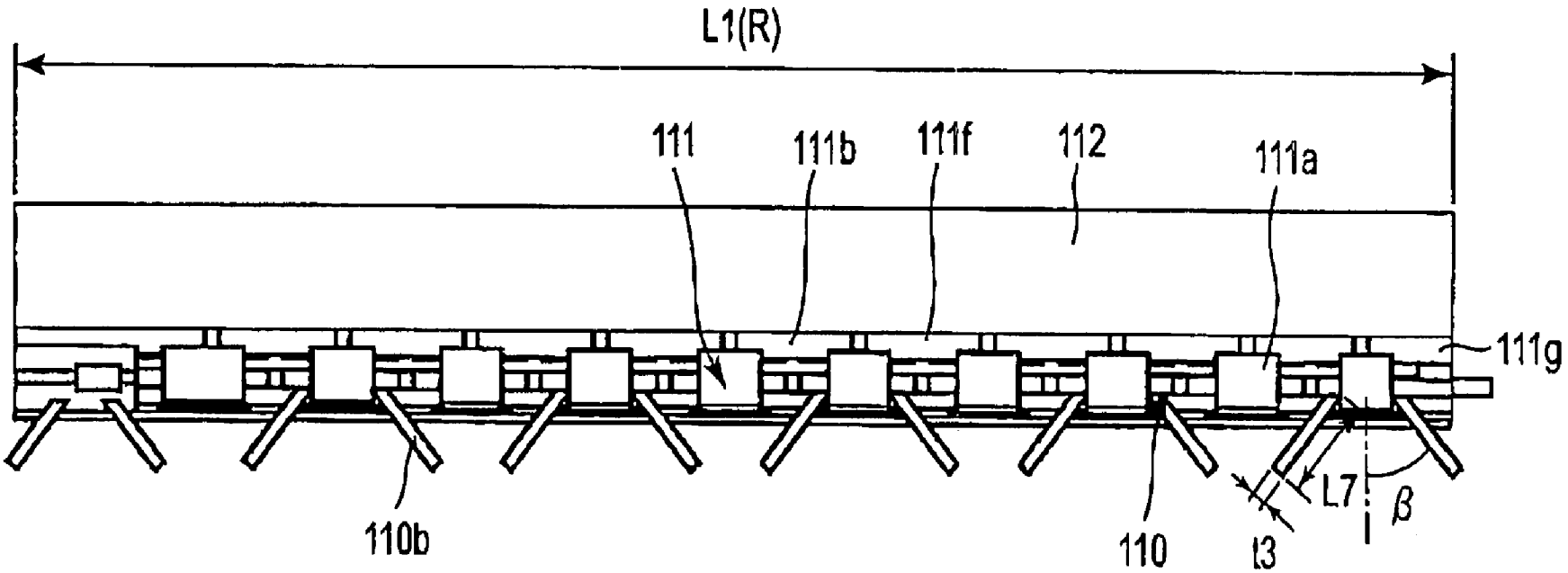
FIG. 13 is a front view of the projections of the solid stirring member in the fourth embodiment of the present invention.

In this embodiment, therefore, the projections 110*b* of the stirring member 110 are reduced in the thickness t3 in terms of the lengthwise direction of the stirring member 110 (direction parallel to axis line of stirring member 110), as shown in FIG. 13. Further, the projections 110*b* are tilted at an angle of β relative to the direction perpendicular to the rotational axis of the stirring member 110 so that each of the projections 110*b* of the stirring member 110 is increased in the developer sweeping range in terms of the direction parallel to the rotational axis of the stirring member 110.

Incidentally, the slit 111*b*, with which the cylindrical portion 111*a* of the stirring member 111 is provided, is made wider, in terms of the lengthwise direction of the stirring member 111, than those in the first and second embodiments, in order to accommodate the tilted projections 110*b*.

The values of the angle β and the length L4 of each projection 110*b* are optional. In other words, the angle β and length L4 have only to be set so that the agglomerated developer is sufficiently loosened by the projections 110*b* before the stirring member 111 is made to begin its stirring motion. However, it is preferable that they are set so that the range, in terms of the lengthwise direction of the stirring member 110, across which the projections 110*b* of the stirring member 110 stir the toner, virtually matches the range R, in terms of the lengthwise direction of the stirring member 111, across which the stirring member 111 stirs the toner. For example, the angle β is desired to be in the range of 30°–45° (β≈30°–45°).

With the provision of the above-described structural arrangement, not only is the mechanical resistance of the toner against the stirring member 110 reduced as the stirring member stirs the toner, but also, the toner stirring efficiency is increased, further reducing the amount of the torque required to rotate the stirring means when starting up the developing apparatus.

As described above, according to this embodiment, the stirring efficiency can be further increased, further reducing therefore the amount of the torque necessary to start up the developing apparatus, without substantially increasing the toner resistance against the stirring means.

Embodiment 5

Next, referring to FIGS. 14, 15(*a*), 15(*b*), 16, 17(*a*), 17(*b*), and 17(*c*), the fifth embodiment of the present invention will be described Referring to FIG. 14, in this embodiment, one end of a stirring means driving gear 131, functioning as a driving force transmitting means, is provided with a one-way clutch 130, which drives the stirring member 110 through the coupling member 122 when the stirring means driving gear 131 is rotating (in direction indicated by arrow mark Y7).

The other end of the stirring member 110 is provided with a spring 140, that is, an elastic member functioning as a pressure generating means. The spring 140 in this embodiment is a torsional coil spring. It keeps the stirring member 110 and stirring member 111 pressured in the direction (indicated by arrow mark Y8) to increase the distance between the stirring members 110 and 111.

Figure 15:
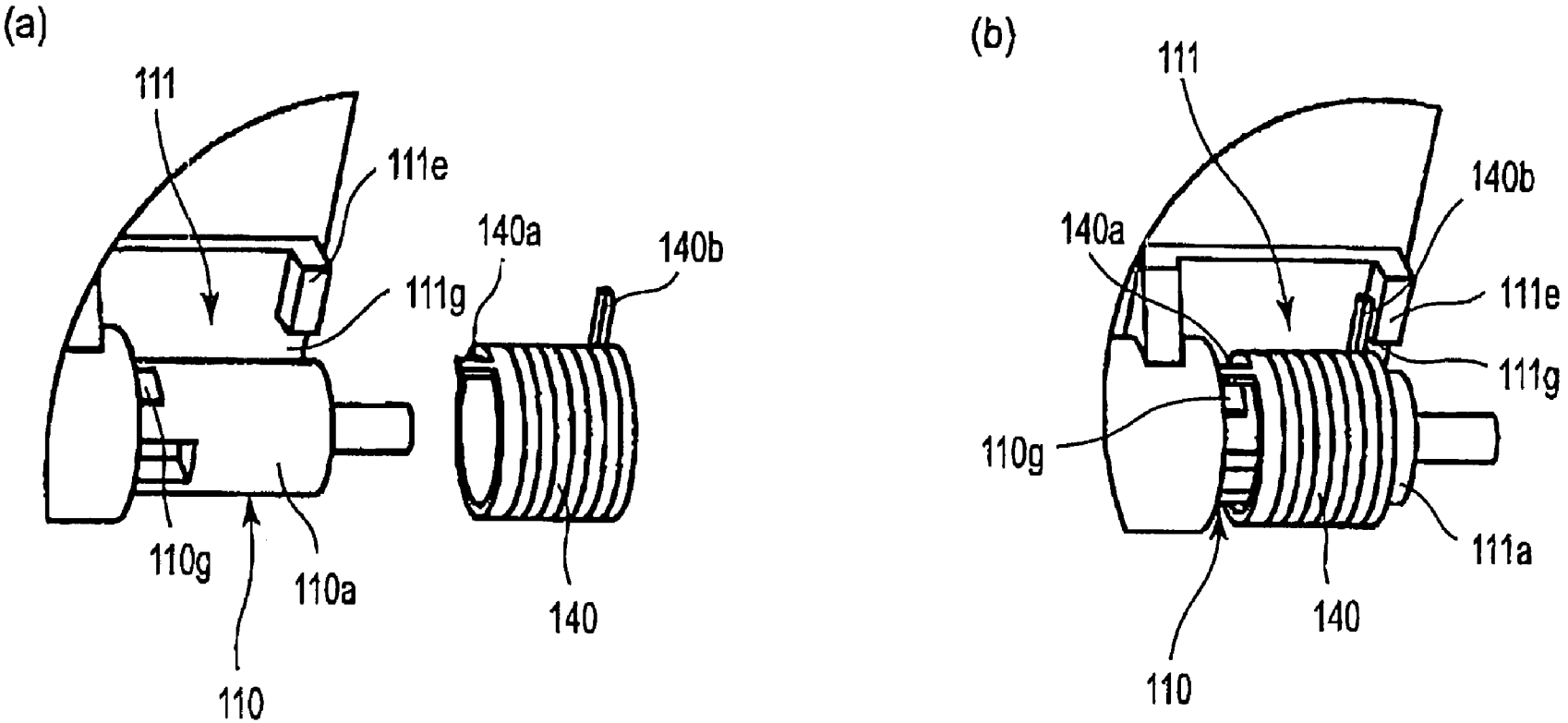
FIGS. 15(*a*) and 15(*b*) are an exploded perspective view and a side view, respectively, showing the spring, in the fifth embodiment, for keeping the stirring means pressured in order to keep the stirring means in the home position when it is unnecessary to star the developer.

Referring to FIGS. 15(*a*) and 15(*b*), the spring 140 is inserted in the aforementioned end of the stirring member 110. One end 140*a* of the spring 140 is anchored to a rotation preventing projection 110*g* of the stirring member 110, located in the adjacencies of one end of the shaft portion 110*a* of the stirring member 110, whereas the other end 140*b* of the spring 140 is hooked to an anchoring projection 111*e* of the spring mount 111*g* of the stirring member 111, located at the other lengthwise end of the spring mount 111*g*.

Figure 14:
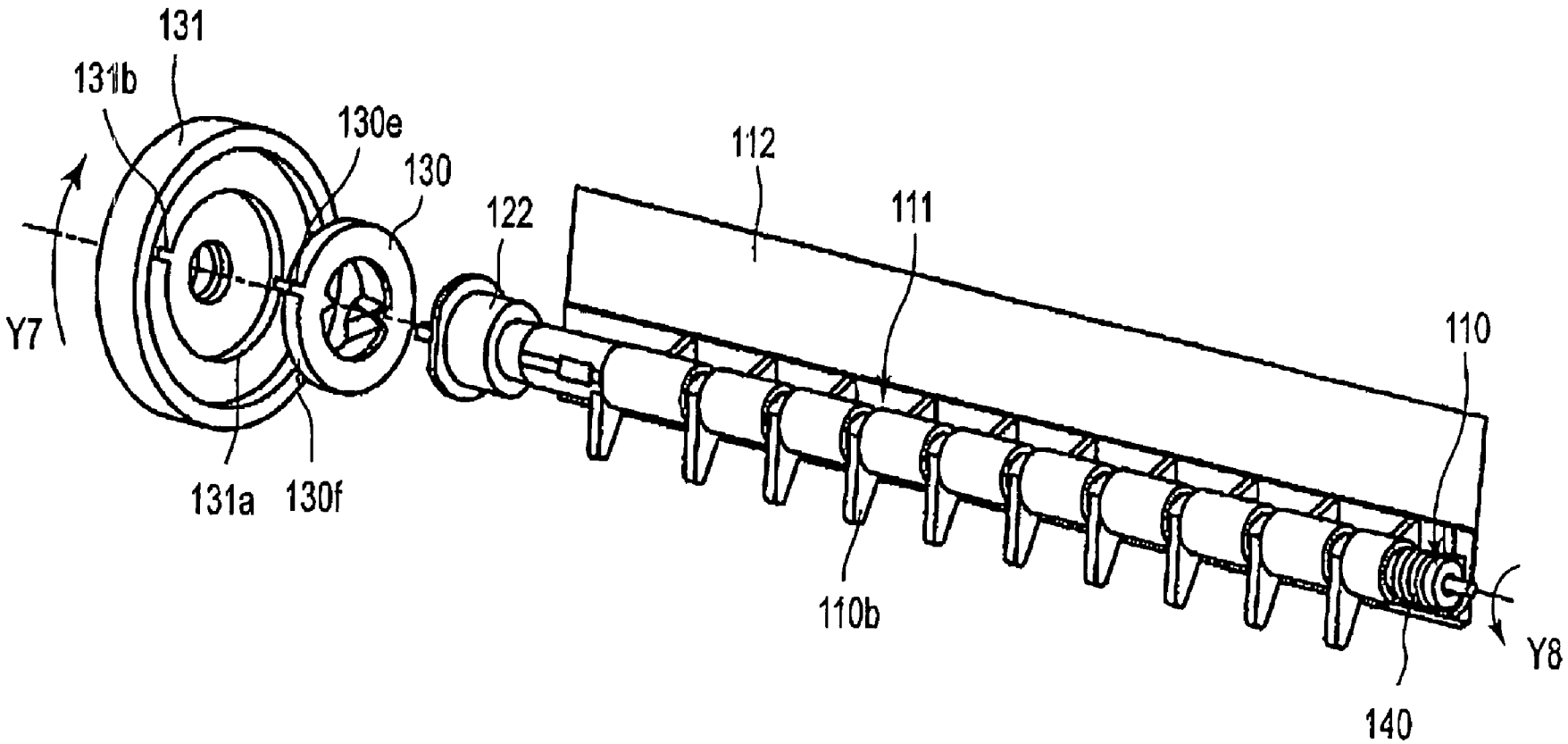
FIG. 14 is a perspective view of the stirring means in the fifth embodiment of the present invention.
Figure 16:
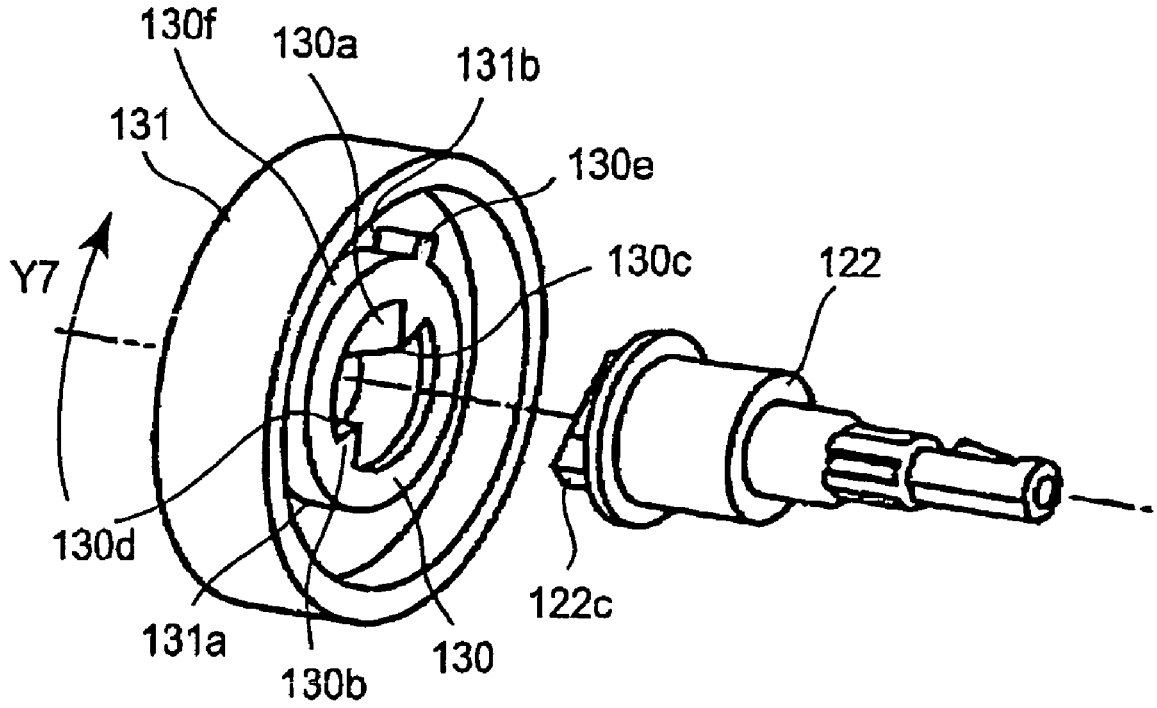
FIG. 16 is an exploded perspective view of the coupler portion of the driving system for the stirring member in the fifth embodiment of the present invention.

Next, to describe the coupling portion in more detail with reference to FIGS. 14 and 16, in the hollow 131*a* of the stirring means driving gear 131, the outer ring 130*f* of the one-way clutch 130 is press-fitted. In the rotation control hole 131*b* of the stirring means driving gear 131, the rotation control rib 130*e* of the one-way clutch 130 is fitted, thereby being prevented from rotating. Further, the one-way clutch 130 is provided with driving force transmitting projections 130*a* and 130*b*, whereas the coupling member 122 is provided with the driving force transmitting rib 122*c*. The one-way clutch 130 and coupling member 122 are positioned relative to each other so that their rotational axes virtually coincide. Thus, as the stirring means driving gear 131 rotates (in direction indicated by arrow mark Y7), driving force transmitting surfaces 130*c* and 130*d* of the driving force transmitting projections 130*a* and 130*b*, respectively, come into contact with the driving force transmitting rib 122*c* of the coupling member 122, thereby transmitting the driving force.

Figure 17:
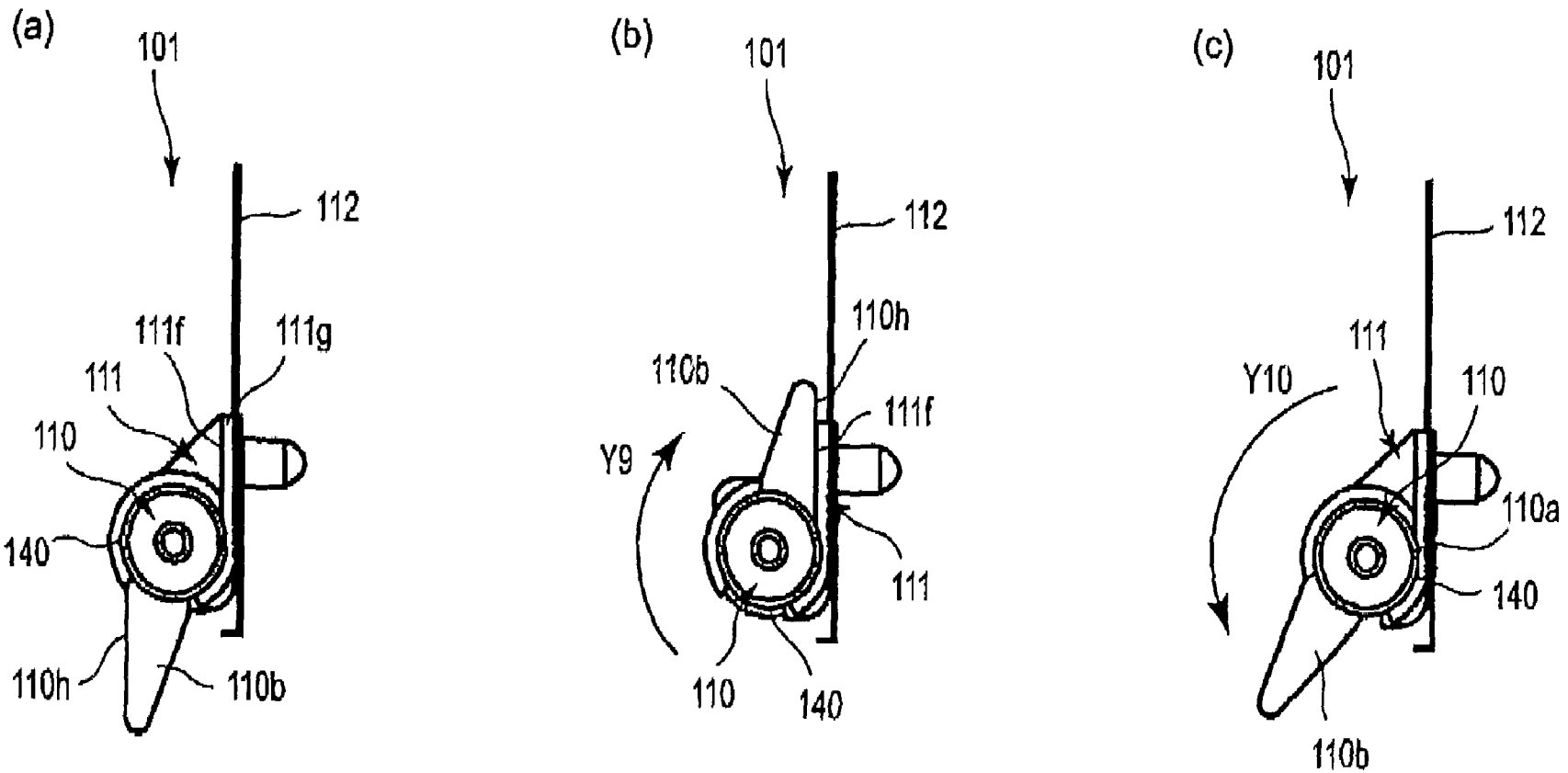
FIGS. 17(*a*)–17(*c*) are side views of the stirring means in the fifth embodiment of the present invention, showing the different in rotational phase between the stirring members 110 and 111.

Next, referring to FIGS. 17(*a*)–17(*c*), as the stirring means 101 structured as described above is rotationally driven in the toner container 21 containing a substantial mount of toner, the amount of the toner resistance against the stirring member 111 is greater than that against the stirring member 110, because the former is greater in the size of the area by which it stirs the toner than the latter. Therefore, the stirring member 110 requires a relatively smaller amount of torque to be rotated. As a result, as the stirring means 101 is rotationally driven, the lo stirring member 110 begins to rotate while compressing the spring 140 against the stirring member 111, which is remaining stationary because of the greater amount of the toner resistance thereupon, before the stirring member 111 begins to rotate. In other words, before the stirring member 111 begins to be rotated, the projections 110*b* of the stirring member 110 loosen the agglomerated toner by stirring it.

Then, the contact portions (downstream surfaces of the projections 110*b* (in terms of the rotational direction of stirring member 110)) 110*h* of the stirring member 110 come into contact with the contact portions (upstream surfaces of the mount 111*g* (in terms of rotational direction of stirring member 111) 111*f* of the stirring member 111 (FIGS. 17(*a*) and 17(*b*)), transmitting the stirring means driving force to the stirring member 111, thereby causing the stirring member 111 to begin to stir the toner. At this point in time, the agglomerated toner has already been loosened by the stirring action of the stirring member 110, having become smaller in mechanical resistance. In other words, the amount of the torque necessary to start stirring the agglomerated toner in the first toner storage portion 21*a* with the stirring means having the stirring member 110 is substantially smaller than that necessary with the stirring means without the stirring member 110.

Then, as the transmission of the driving force to the cartridge C is stopped at the end of the image formation process, the stirring of the toner by the stirring means 101 also stops. At this point of time, the stirring members 110 and 111 are still kept pressured by the spring 140 in a manner to rotate the stirring means in the direction indicated by an arrow mark Y8 in FIG. 14.

The stirring member 111 is greater in the area by which it stirs the toner than the stirring member 110, being therefore greater in the toner resistance than the stirring member 110. Therefore, the stirring member 111 remains stationary while the stirring member 110 is rotated in reverse by the pressure generated by the spring 140, because of the presence of the one-way clutch 130. As a result, the projection 110*b* of the stirring member 110 are rotated back (in direction indicated by arrow mark Y10 in FIG. 17(*c*)) to the initial positions (home position), in which they are different in rotational phase from the elastic sheet 112 of the stirring member 111 fixed to the mount 111*g*.

As will be evident from the above description of this embodiment, with he employment of the structural arrangement in this embodiment, not only is the amount of the torque necessary to start stirring the toner in the cartridge C smaller when the cartridge C is used for the very first time, but also, every time the cartridge C is used thereafter. In other words, with the employment of the structural arrangement in this embodiment, should the developer in the cartridge C having been loosened when the cartridge is used for the first time become agglomerated again while the image forming apparatus is not used, the amount of the torque necessary to start stirring the toner in the cartridge C when the apparatus is used again, is just as small as that necessary when the cartridge C is used for the first times.

Embodiment 6

Next, referring to FIGS. 18(*a*)–18(*c*), the sixth embodiment of the present invention will be described In the fifth embodiment, the combination of the one-way clutch 130 and spring 140 was used to make the projections 110*b* of the stirring member 110 different in rotational phase from the elastic sheet 112 fixed to the stirring member 111 when the stirring means is not rotating.

In this embodiment, instead of employing the one-way clutch 130, the strength, in terms of resiliency, of the spring 140 alone is used to make the projections 110*b* of the stirring member 110 different in rotational phase from the elastic sheet 112 fixed the stirring member 111.

To describe this feature in more detail, the spring 140 is fixed in the same manner as that in the fifth embodiment, and is used to keep the stirring members 110 and 111 pressured in the direction to widen the distance between the two stirring members 110 and 111. In this embodiment, however, the strength f0 of the spring 140, the amount fa of mechanical resistance the agglomerated toner generates, and the amount fb of the mechanical resistance the completely loosened toner generates, are set so that their relationship satisfies an inequality: fb=f0<fa.

Figure 18:
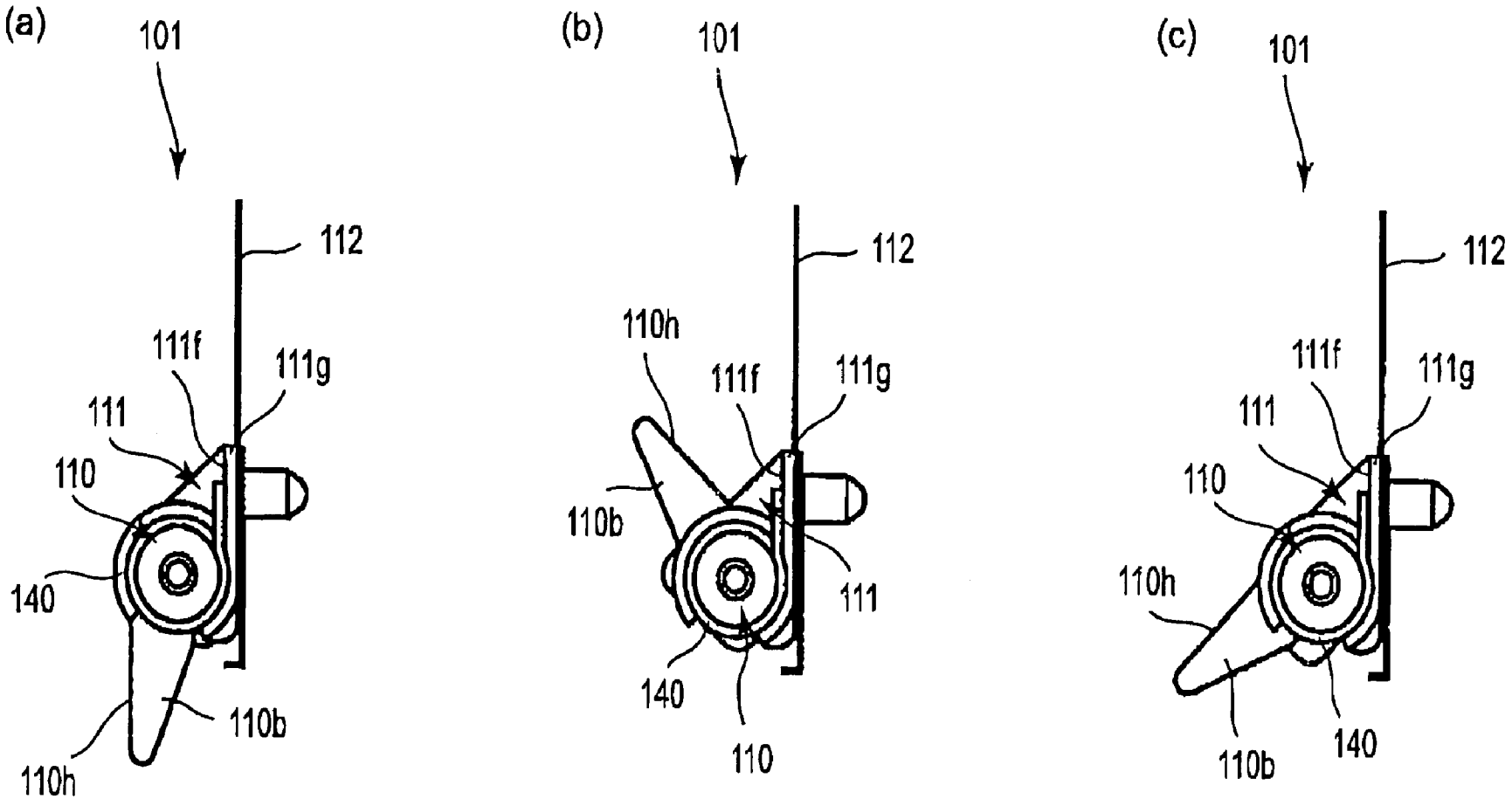
FIGS. 18(*a*) and 18(*b*) are side views of the stirring means in the sixth embodiment of the present invention, showing the different in rotational phase between the stirring members 110 and 111.

Referring to FIGS. 18(*a*)–18(*c*), with the stirring means 101 being configured as described above, the stirring member 111 is greater in the size of the surface with which it stirs the toner than the stirring member 110. Therefore, the amount of the mechanical resistance generated by the toner against the stirring member 111 as the stirring means 101 is rotationally driven is greater than that generated by the stirring member 110. As a result, the stirring member 110 rotatable with a relatively smaller amount of torque begins to rotate, gradually compressing the spring 140, while the stirring member 111 remains stationary. During this rotational movement of the stirring member 110, the projections 110*b* of the stirring member 110 loosen the toner.

Then, as the amount of the resiliency f1 of the spring 140 in the compressed state becomes equal to the amount fc (fb<fc<fa) of the mechanical resistance which the body of the toner being loosened generates, or the contact portion 110*h* (the downstream surface of projection 110*b* in terms of rotational direction of the stirring member 110) of the stirring member 110 comes into contact with the contact portion 111*f* (the upstream surface of the mount 111*g* in terms of the rotational direction of the stirring member 111) of the stirring member 111, the stirring member 111 begins to stir the toner (FIG. 18(*a*) and 18(*b*)). At this point in time, the toner has already been loosened by the stirring movement of the stirring member 110, having therefore been reduced in mechanical resistance. Therefore, the amount of the torque necessary to start rotating the stirring means 101 having the stirring member 110 is much smaller than that necessary to start rotating the stirring member 101 having no stirring member 110.

Thereafter, the amount of the resiliency of the compressed spring 140 is greater than the mechanical resistance the loosened toner generates as the stirring member 111 is rotated. Further, the stirring member 110 is prevented from rotating in reverse, because the driving force is being transmitted to the stirring member 110. As a result, the stirring member 111 is rotated by the resiliency of the compressed spring 140 faster than the stirring member 110, increasing thereby the distance between the contact portion 111*f* of the stirring member 111 and the contact portion 110*h* of the stirring member 110.

As described above, in this embodiment, the relationship in terms of the rotational phase between the projections 110*b* of the solid stirring member 110 and the elastic sheet 112 fixed to the mount 111*g* of the stirring member 111 is restored to the initial state in which the former is substantially different in rotational phase from the latter (FIG. 18(*c*)), before the stirring means 101 stops its stirring movement. Then, after the cessation of the transmission of the driving force to the cartridge C at the end of the image formation process, the restored difference in the rotational phase is maintained between the projections 110*b* and the elastic sheet 112 fixed to the stirring member 111 (home position).

Further, instead of using the combination of the one-way clutch 130 and spring 140 in the fifth embodiment as the mechanism for returning the stirring member 110 to the initial position (home position), the stirring member 110 can be moved to the initial position (home position) in the following manner. For example, a stirring means driving gear 121 (FIGS. 3 and 4) can be utilized as the pressure generating means for rotating the stirring member 110 in reverse in order to move the stirring member 110 back into the position in which the stirring member 110 is different in rotational phase from the stirring member 111. In such a case, it is desired that the stirring means 101 is driven by a driving means independent from the photosensitive drum 10 and development roller 20 of the cartridge C, in order to prevent the photosensitive drum 10 and development roller 20 from being rotated in reverse as the stirring member 110 is rotated in reverse.

As described above, according to the structural arrangement in this embodiment, not only is the amount of the torque necessary to start stirring the toner in the cartridge C for the very first time smaller, but also, every time the cartridge C is used thereafter, as in the fifth embodiment in other words, with the employment of the structural arrangement in this embodiment, should the developer in the cartridge C, having been loosened when the cartridge is used for the first time, become agglomerated again while the image forming apparatus is not used, the amount of the torque necessary to start stirring the toner in the cartridge C when the apparatus is used again, is just as small as that necessary when the cartridge C is used for the first time. In addition, the structural arrangement in this embodiment is simpler than that in the fifth embodiment.

(Experiments)

Next, the results of the representative experiments among the various experiments carried out to prove the effectiveness of the present invention will be described. The following are the results of the experiments in which the cartridges C equipped with the above described stirring means 101 in the second and fourth embodiments were tested.

All the tested cartridges were structured as follows. They were provided with only one stirring means (second stirring means 101), and were reduced in the size of the toner storage portion (gap between first and second toner storage portions was closed so that toner was stored only in second toner storage portion 21*b*). Their toner storage portions were filled with 500 g of toner, and they were firmly anchored with the cleaning means container 15 placed on top and toner container 21 placed at the bottom.

Then, all of them were subjected to the following operations. They were tapped with the use of a tapping apparatus built in house. The tapping amplitude was 15 mm, and tapping frequency was 1.5 times/sec. They were tapped 1,000 times. After the completion of the tapping process, the test cartridges were mounted on a torque measuring apparatus while making very sure that the test cartridge would not be subjected to vibrations. Then, the amount of the torque necessary to drive the stirring means was measured while rotating the stirring means at 90 rpm.

The specifications of the stirring members used in the experiments were as follows. Incidentally, the specifications of the stirring members other than the one in the second embodiment were similar to those of the stirring members in the second embodiment, they will not be discussed to avoid repetition.

Stirring Members In Embodiment 2

- Stirring Member 110:
- Thickness t3 of projection 110*b:* 6 mm
- Projection interval d1: 17 mm
- Number of projections: 12
- Dimension L3 of projection 110*b:* 10.5 mm (in terms of radius direction of shaft portion)
- Amount of overlap relative to stirring member 111: 14.2 mm
- Stirring Member 111:
- Thickness t1 of elastic sheet 112: 100 μm
- Dimension L1 of elastic sheet 112: 213 mm (in terms of lengthwise direction of stirring member 111)
- Dimension L2 of elastic sheet 112: 23.5 mm (in terms of radius direction of shaft portion)

Stirring Members in Embodiment 4

- Stirring Member 110:
- Thickness t3 of projection 110*b:* 4 mm
- Number of projections: 12
- Dimension L7 of projection 110*b:* 10.6 mm (in terms of radius direction of shaft portion)
- Angle β of projections: 13.5°

Comparative Stirring Means

Comparative stirring means were not provided with the stirring member 110, and the force for diving the stirring member 111 was transmitted from the stirring means driving gear 121 directly through the coupling member 122.

The amount of the torque necessary to start rotating the comparative stirring means for the first time was 10.5 kgf cm (103 N cm) at the rotational shaft of the stirring member.

In comparison, the amounts of the torque necessary to start rotating the stirring means in the second and fourth embodiments were 8.0 kgf cm (78 N cm) and 7.5 kgf cm (74 N cm), respectively, at the rotational shafts of the stirring members.

As will be understood from the test results given above, it was possible to confirm that the employment of the stirring means in the second and fourth embodiments of the present invention could reduce the amount of the torque necessary to start rotating the stirring means for the very first time, by 25 kgf cm (25 N cm) and 3.0 kgf cm (29 N cm), respectively, measured at the rotational shafts of the stirring means, compared to the comparative stirring means. It was also confirmed, through the experiments in which the stirring means in accordance with the present invention other than those in the second and fourth embodiments were tested and studied, that the stirring means in accordance with the present invention were highly effective to reduce the amount of the torque necessary to start rotating the stirring means for the very first time.

In the above, the present invention was described with reference to the preferred embodiments thereof. However, these embodiments are not intended to limit the precise positioning, measurements, material, shape, etc., of the stirring means in accordance with the present invention to those described above. It should be understood that the present invention includes various modifications of the preceding embodiments made within the scope of the present invention.

Incidentally, a process cartridge is a cartridge in which an electrophotographic photosensitive member, and at least one among a developing means, a charging means, and a cleaning means, as processing means which act on the electrophotographic photosensitive member, are integrally placed, and which is removably mountable in the main assembly of an electrophotographic image forming apparatus. The application of the present invention is not limited to the process cartridges in the preceding embodiments of the present invention, which are such cartridges in which an electrophotographic photosensitive member developing is means, charging means, and cleaning means are integrally placed. In other words, the present invention is applicable to any process cartridge as long as it comprises a developer container in which a developing means is supported, and developer is stored, and which is equipped with a stirring member for stirring the developer therein.

The present invention is also applicable to a cartridge (development cartridge) which is removably mountable in the main assembly Pa of an electrophotographic image forming apparatus, and in which a developing apparatus comprising a developer storage portion and a developing means is placed. Such a development cartridge is equivalent to the development unit (developing apparatus) A, that is, a cartridge which results as the photosensitive drum unit B is removed from one of the cartridges in the preceding embodiments of the present invention. Therefore, it will not be described here, and for their description, the descriptions of the preceding embodiments will suffice.

As described above, the present invention can reduce the amount of the force necessary to start stirring the developer at the startup of an electrophotographic image forming apparatus, making it therefore possible to reduce the size of the motor of the electrophotographic image forming apparatus, which in turns makes it possible to reduce the electrophotographic image forming apparatus in size.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 308151/2003 filed Aug. 29 2003, which is hereby incorporated by reference.

What is claimed is:

1. A developing apparatus for an electrophotographic image forming apparatus, said developing apparatus comprising:

a developing device configured and positioned to develop an electrostatic latent image formed on an electrophotographic photosensitive member;

a developer accommodating container configured to accommodate a developer to be used by said developing device;

a first stirring member configured and positioned to receive a driving force from a main assembly of the electrophotographic image forming apparatus to stir the developer accommodated in said developer accommodating container; and a second stirring member configured and positioned to stir the developer accommodated in said developer accommodating container, said second stirring member being rotatable by being contacted by said first stirring member rotated through a predetermined angle when said first stirring member receives the driving force from the main assembly of the apparatus.

wherein said first stirring member stirs at least a part of a region of the developer which is stirred by said second stirring member.

2. An apparatus according to claim 1, wherein said second stirring member is rotatably supported on said first stirring member.

3. An apparatus according to claim 1, wherein the contact area between said first stirring member and the developer in said developer accommodating container is smaller than the contact area between said second stirring member and the developer in said developer accommodating container.

4. An apparatus according to claim 1, wherein said first stirring member has a plurality of projections extending in a direction crossing the longitudinal direction of said first stirring member, and after said first stirring member is rotated through the predetermined angle, at least one of said projections contacts said second stirring member to rotate said second stirring member.

5. An apparatus according to claim 1, wherein said first stirring member and said second stirring member are in the form of sheets, respectively, and the sheet of said first stirring member has a thickness which is smaller than the thickness of the sheet of said second stirring member.

6. An apparatus according to claim 1, further comprising a spring member configured and positioned to urge said second stirring member to stop said first stirring member and said second stirring member at respective phase positions which are different from each other when the receipt of the driving force for said first stirring member from the main assembly of the apparatus is completed.

7. A process cartridge detachably mountable to a main assembly of an electrophotographic image forming apparatus, said process cartridge comprising:

an electrophotographic photosensitive member;

a developing device configured and positioned to develop an electrostatic latent image formed on said electrophotographic photosensitive member;

a developer accommodating container configured to accommodate a developer to be used by said developing device;

a first stirring member configured and positioned to receive a driving force from a main assembly of the electrophotographic image forming apparatus to stir the developer accommodated in said developer accommodating container; and a second stirring member configured and positioned to stir the developer accommodated in said developer accommodating container, said second stirring member being rotatable by being contacted by said first stirring member rotated through a predetermined angle when said first stirring member receives the driving force from the main assembly of the apparatus, wherein said first stirring member stirs at least a part of a region of the developer which is stirred by said second stirring member.

8. A process cartridge according to claim 7, wherein said second stirring member is rotatably supported on said first stirring member.

9. A process cartridge according to claim 7, wherein the contact area between said first stirring member and the developer in said developer accommodating container is smaller than the contact area between said second stirring member and the developer in said developer accommodating container.

10. A process cartridge according to claim 7, wherein said first stirring member has a plurality of projections extending in a direction crossing the longitudinal direction of said first stirring member, and after said first stirring member is rotated through the predetermined angle, at least one of said projections contacts said second stirring member to rotate said second stirring member.

11. A process cartridge according to claim 7, wherein said first stirring member and said second stirring member are in the form of sheets, respectively, and the sheet of said first stirring member has a thickness which is smaller than the thickness of the sheet of said second stirring member.

12. A process cartridge according to claim 7, further comprising a spring member configured and positioned to urge said second stirring member to stop said first stirring member and said second stirring member at respective phase positions which are different from each other when the receipt of the driving force by said first stirring member from the main assembly of the apparatus is completed.

13. An electrophotographic image forming apparatus for forming an image on a recording material, said apparatus comprising:

(i) a driving motor;

(ii) an electrophotographic photosensitive member:

(iii) a developing apparatus including:

a developing device configured and positioned to develop an electrostatic latent image formed on said electrophotographic photosensitive member;

a developer accommodating container configured the accommodate a developer to be used by said developing device;

a first stirring member configured and positioned to receive a driving force from said driving motor in a main assembly of the electrophotographic image forming apparatus to stir the developer accommodated in said developer accommodating container; and a second stirring member configured and positioned to stir the developer accommodated in said developer accommodating container, said second stirring member being rotatable by being contracted by said first stirring member rotated through a predetermined angle when said first stirring member receives the driving force from the main assembly of the apparatus, wherein said first stirring member stirs at least a part of a region of the developer which is stirred by said second stirring member; and (iii) a feeding device configured and positioned to feed the recording material.

14. An electrophotographic image forming apparatus for forming an image on a recording material, said apparatus comprising:

(i) a driving motor;

(ii) a mounting device configured and positioned to mount a process cartridge, the process cartridge including an electrophotographic photosensitive member, a developing device configured and positioned to develop an electrostatic latent image formed on the electrophotographic photosensitive member, a developer accommodating container configured to accommodate a developer to be used by said developing device, a first stirring member configured and positioned to receive a driving force from said driving motor of a main assembly of said electrophotographic image forming apparatus to stir the developer accommodated in the developer accommodating container, and a second stirring member configured and positioned to stir the developer accommodated in the developer accommodating container, the second stirring member being rotatable by being contacted by the first stirring member rotated through a predetermined angle when the first stirring member receives the driving force from the main assembly of said apparatus, wherein the first stirring member stirs at least a part of a region of the developer which is stirred by the second stirring member; and (iii) a feeding device configured and positioned to feed the recording material.

* * * * *

UNITED STATES PATENT AND TRADEMARK OFFICE

CERTIFICATE OF CORRECTION

PATENT NO. : 7,110,703 B2
APPLICATION NO. : 10/927109
DATED : September 19, 2006
INVENTOR(S) : Shunsuke Uratani et al.

It is certified that error appears in the above-identified patent and that said Letters Patent is hereby corrected as shown below:

ON THE COVER PAGE
At Item (57), Abstract, line 9, “star” should read --stir--.

COLUMN 1
Line 44, “above mentioned” should read --above-mentioned--.

COLUMN 4
Line 23, “one” should read --one of--.
Line 39, “star” should read --stir--.
Line 45, “different” should read --difference--.
Line 49, “different” should read --difference--.

COLUMN 5
Line 25, “an,” should read --an--.

COLUMN 12
Line 17, “the,” should read --the--.
Line 45, “lo” should be deleted.

COLUMN 13
Line 34, “synchronizing” should read --synchronized--.

COLUMN 14
Line 44, “1s” should be deleted.

COLUMN 15
Line 22, “screws in” should read --screws. In--.

COLUMN 16
Line 22, “stirring,” should read --stirring--.

COLUMN 18
Line 20, “lo” should be deleted.

COLUMN 19
Line 10, “times.” should read --time.--.
Line 15, “described” should read --described.--.
Line 25, “fixed” should read --fixed to--.

UNITED STATES PATENT AND TRADEMARK OFFICE

CERTIFICATE OF CORRECTION

PATENT NO. : 7,110,703 B2
APPLICATION NO. : 10/927109
DATED : September 19, 2006
INVENTOR(S) : Shunsuke Uratani et al.

It is certified that error appears in the above-identified patent and that said Letters Patent is hereby corrected as shown below:

COLUMN 20
Line 63, "above described" should read --above-described--.

COLUMN 22
Line 30, "is" should be deleted.
Line 56, "turns" should read --turn--.

COLUMN 24
Line 43, "member:" should read --member;--.
Line 48, "the" should read --to--.

Signed and Sealed this

Twenty-ninth Day of May, 2007

JON W. DUDAS
*Director of the United States Patent and Trademark Office*